US010669084B1

(12) United States Patent
Keegan

(10) Patent No.: US 10,669,084 B1
(45) Date of Patent: Jun. 2, 2020

(54) EQUIPMENT LOCKING BOX

(71) Applicant: Green Touch Industries, Inc., Lake Park, FL (US)

(72) Inventor: Daniel J. Keegan, Riviera Beach, FL (US)

(73) Assignee: Green Touch Industries, Inc., Lake Park, FL (US)

( * ) Notice: Subject to any disclaimer, the term of this patent is extended or adjusted under 35 U.S.C. 154(b) by 1 day.

(21) Appl. No.: 16/036,683

(22) Filed: Jul. 16, 2018

(51) Int. Cl.

| | |
|---|---|
| ***B65D 6/02*** | (2006.01) |
| ***B25H 3/00*** | (2006.01) |
| ***B65D 55/14*** | (2006.01) |
| ***B65D 6/08*** | (2006.01) |
| ***B65D 6/00*** | (2006.01) |
| *B27B 17/02* | (2006.01) |
| *A47B 81/00* | (2006.01) |

(52) U.S. Cl.
CPC ..... *B65D 55/14* (2013.01); *B25H 3/006* (2013.01); *B65D 7/06* (2013.01); *B65D 7/12* (2013.01); *B65D 7/14* (2013.01); *A47B 81/005* (2013.01); *B27B 17/02* (2013.01)

(58) Field of Classification Search
CPC ... B65D 7/40; B65D 7/14; B65D 7/12; B65D 7/06; B65D 25/005; B25H 3/006; A47B 81/005
USPC ..... 220/676; 206/485, 349
See application file for complete search history.

(56) References Cited

U.S. PATENT DOCUMENTS

| | | | |
|---|---|---|---|
| 504,683 | A | 9/1893 | Peartree |
| 763,461 | A | 6/1904 | Burton |
| 1,291,430 | A | 1/1919 | Davenport |
| 2,016,132 | A | 10/1935 | Bergslien |
| 3,326,385 | A | 6/1967 | Pinkerton |
| 3,625,563 | A | 12/1971 | Dickinson |
| 3,664,164 | A | 5/1972 | Zaidener |
| 3,767,093 | A | 10/1973 | Pinkerton |
| 3,854,428 | A | 12/1974 | Fullenkamp |
| 4,450,989 | A | 5/1984 | Bogar, Jr. |

(Continued)

OTHER PUBLICATIONS www.trimmertrap.com/racks/tt2 htm (posted at least as of Aug. 20, 2007); 3 pages.

(Continued)

*Primary Examiner* — Mollie Impink

(74) *Attorney, Agent, or Firm* — Sheppard Mullin Richter & Hampton LLP

(57) ABSTRACT

An equipment locking system. The system includes a base container forming a partial enclosure. The base container including a bottom wall, a set of sidewalls, a rotatable anti-intrusion lid, and a locking mechanism that form a partial enclosure. The partial enclosure is configured to enclose a piece of equipment. The partial enclosure is configured to prevent access to the piece of equipment when the rotatable anti-intrusion lid is closed. Portions of the piece of equipment may protrude from gaps in individual sidewalls of the set of sidewalls. The rotatable anti-intrusion lid can be coupled to a sidewall of the set of sidewalls and rotated about the sidewall. Portions of the rotatable anti-intrusion lid can be inserted in the locking mechanism. The locking mechanism may restrict rotation of the rotatable anti-intrusion lid when the rotatable anti-intrusion lid is in the closed position, and the locking mechanism is in a locked position.

19 Claims, 17 Drawing Sheets

(56) References Cited

U.S. PATENT DOCUMENTS

| | | | | |
|---|---|---|---|---|
| 4,596,334 | A | 6/1986 | Daulton | |
| 4,696,405 | A | 9/1987 | Waring | |
| 4,776,471 | A | 10/1988 | Elkins | |
| 4,805,781 | A | 2/1989 | Tegel | |
| 4,946,186 | A | 8/1990 | Cheng | |
| 4,967,942 | A | 11/1990 | McGruder | |
| 5,138,786 | A * | 8/1992 | Fischer | E05B 73/00 211/64 |
| 5,169,114 | A | 12/1992 | O'Neill | |
| 5,451,072 | A | 9/1995 | Weng | |
| 5,524,772 | A | 6/1996 | Simmons | |
| 5,647,489 | A | 7/1997 | Bellis, Jr. | |
| 5,853,223 | A | 12/1998 | Ritt | |
| 5,873,275 | A | 2/1999 | Lukich | |
| 5,879,014 | A | 3/1999 | Price | |
| 5,964,358 | A | 10/1999 | Hafendorfer | |
| 6,073,781 | A | 6/2000 | Puglisi | |
| 6,138,483 | A | 10/2000 | Galant | |
| 6,173,842 | B1 | 1/2001 | Fitzgerald | |
| 6,182,840 | B1 | 2/2001 | Tegel | |
| 6,185,917 | B1 | 2/2001 | Goudes | |
| 6,302,280 | B1 | 10/2001 | Bermes | |
| 6,311,853 | B1 | 11/2001 | Johnson | |
| 6,371,309 | B1 | 4/2002 | Smith | |
| 6,409,029 | B1 | 6/2002 | Bermes | |
| 6,484,544 | B1 | 11/2002 | Wing | |
| 6,648,152 | B2 | 1/2003 | Bermes | |
| 6,536,610 | B1 | 3/2003 | Taylor | |
| 6,619,485 | B1 | 9/2003 | Jenkins | |
| 6,845,640 | B2 * | 1/2005 | Loeff | E05B 53/003 109/45 |
| 6,966,540 | B2 | 4/2005 | Falk | |
| 7,044,347 | B1 | 5/2006 | Pedrini | |
| 7,594,415 | B1 | 9/2009 | Wu | |
| 7,703,778 | B2 | 4/2010 | Refsum | |
| 7,762,408 | B2 | 7/2010 | Sargent | |
| 7,849,557 | B1 | 12/2010 | Bellis, Jr. | |
| 7,997,595 | B1 | 8/2011 | Pope | |
| 8,021,278 | B2 | 9/2011 | Huyck | |
| 8,141,836 | B2 | 3/2012 | Saez | |
| 8,220,764 | B2 | 7/2012 | Ziaylek | |
| 8,245,859 | B2 | 8/2012 | Sargent | |
| 8,272,999 | B2 | 9/2012 | Huyck | |
| 8,365,969 | B2 | 2/2013 | Johnson | |
| 8,480,170 | B2 | 7/2013 | Lu | |
| 8,640,888 | B2 | 2/2014 | Liu | |
| 9,010,007 | B2 * | 4/2015 | Chandler | F41A 17/04 206/315.11 |
| 2003/0160408 | A1 | 8/2003 | Liao | |
| 2005/0132531 | A1 | 6/2005 | Haberlein | |
| 2005/0205750 | A1 | 9/2005 | Hafendorfer | |
| 2006/0219849 | A1 | 10/2006 | Chiu | |
| 2007/0051026 | A1 * | 3/2007 | Vor Keller | F41A 17/02 42/70.11 |
| 2007/0090069 | A1 | 4/2007 | Hafendorfer | |
| 2007/0215781 | A1 | 9/2007 | Watt | |
| 2007/0235600 | A1 | 10/2007 | Herold | |
| 2008/0078727 | A1 | 4/2008 | Sargent | |
| 2010/0170924 | A1 | 7/2010 | Johnson | |
| 2010/0276380 | A1 | 11/2010 | Sargent | |
| 2011/0147547 | A1 | 6/2011 | Fitzpatrick | |
| 2011/0240572 | A1 | 10/2011 | Kerman | |
| 2012/0043290 | A1 | 2/2012 | Keyvanloo | |
| 2015/0260480 | A1 * | 9/2015 | Dunn | F41C 33/06 42/70.11 |

OTHER PUBLICATIONS www.rackemmfg.com/open.shtml (posted at least as of Aug. 20, 2007); 2 pages.

www.junglejimsap.com/trailerracks.html (posted at least as of Aug. 20, 2007); 3 pages.

* cited by examiner

EQUIPMENT LOCKING BOX

FIELD OF THE DISCLOSURE

The present disclosure relates to a system for equipment securing apparatus.

BACKGROUND

Equipment theft is a common occurrence. Properly securing equipment to prevent theft and enable convenient access may be difficult.

SUMMARY

One aspect of the disclosure relates to systems for equipment securing apparatus configured to fasten, enclose, and/or secure a piece of equipment. For example, the piece of equipment may be a handheld equipment such as a chainsaw and/or other handheld equipment. The apparatus may include a base container forming a partial enclosure for the piece of equipment. The partial enclosure may be shaped in the form of a box with one or more walls, a lid, and/or other components. The one or more walls may include one or more gaps, one or more anti-intrusion lips, and/or other components. The one or more gaps may be configured to enable portions of the equipment (such as a handle or sawblade of the chainsaw) to extend/protrude from the base container. The one or more anti-intrusion lips may be configured to prevents intrusion into the partial enclosure.

In some implementations, a system for equipment securing apparatus may include a based container forming a partial enclosure. The based container may be in the shape of a box and/or other shapes. The base container may include a base wall, a set of side walls, a rotatable anti-intrusion lid, a locking mechanism, and/or other components. The base wall, the individual sidewalls of the set of side walls, and/or the rotatable anti-intrusion lid may comprise a solid body having one or more surfaces, one or more edges, and/or other features. The solid body may be a rectangular shape, a substantially rectangular shape, and/or other shapes.

The base wall may be a bottom portion of the based container. The base wall may be a base of the based container. The base wall may be configured to partially enclose the equipment. The base wall may include one or more fastener openings and/or other components. The fastener openings may be an opening on the surface of the base wall configured for a fastener to fasten the base wall or the base container to a surface.

The set of sidewalls may include a first sidewall, a second sidewall, a third sidewall, a fourth sidewall, and/or other sidewalls. The individual sidewalls of the set of sidewalls may include one or more of an anti-intrusion lip, air vents, fastener openings, equipment accommodation gaps, hinges, a lock attachment, and/or other components. The anti-intrusion lip may be a part of the sidewall that prevents tampering of the equipment enclosed in the base container. The air vents may be a structure with an opening that enables the flow of air. The fastener openings may be a structure with one or more openings for a fastener to be insert through the opening such that the fastener may fasten the sidewalls to a physical object. The equipment accommodation gaps may be an opening that enables portions of the equipment to extend/protrude from within the based container. The equipment accommodation gaps include a handle-accommodation gap on the first side wall, a functional-end-accommodation gap on the second sidewall, and/or other equipment accommodation gaps on other sidewalls.

The individual sidewalls of the set of sidewalls may be configured to partially enclose the equipment. The set of sidewalls may be positioned relative to the base wall such that the set of sidewalls and the base wall form the partial enclosure. The individual sidewalls of the set of sidewalls may be positioned along the perimeter of the base wall. The individual sidewalls of the set of sidewalls may form the sides of the base container. The set of sidewalls may be positioned relative to the base wall to form a box-like structure. The surfaces of the individual sidewalls of the set of sidewalls may be positioned orthogonal to a surface of the base wall. The individual edges of the individual sidewalls of the set of sidewalls may be joined to the individual edges of the base wall.

The rotatable anti-intrusion lid may be positioned on a top portion of the based container. The rotatable anti-intrusion lid may be a lid of the base container. The rotatable anti-intrusion lid may be configured to partially enclose the equipment. The rotatable anti-intrusion lid may be removably coupled to a sidewall of the set of sidewalls. The rotatable anti-intrusion lid may include one or more anti-intrusion lips, one or more lid attachment structures, one or more lock adaptors, one or more cutaways, and/or other components. The rotatable anti-intrusion lid may be removably coupled to a sidewall with the lid attachment structure and/or other components. The lid attachment structure may be coupled to the shielded hinge.

The lock adaptors may be coupled to the locking mechanism. The lock adaptors may be coupled to the locking mechanism to prevent the rotation of the rotatable anti-intrusion lid. The lock adaptors may be inserted into the locking mechanism. The lock adaptors may include one or more locking openings and/or other components. The lock adaptors may be inserted through the one or more receptacles of the locking mechanism to secure (e.g., lock) the lock adaptors within the locking mechanism. Securing the lock adaptors within the locking mechanism may prevent movement of the rotatable anti-intrusion lid.

The locking mechanism may be configured to restrict and/or restrict the movement of the anti-intrusion lid. The locking mechanism may include one or more of an outer shell housing, one or more internal locking mechanisms, one or more handles, one or more rotation limiter bolts, one or more rotational restriction locks, one or more rotational restriction lock attachments, one or more lock housings, and/or other components. The outer shell housing may enclose the components of the internal locking mechanisms and/or other components of the locking mechanism. The outer shell housing may include one or more receptacles. Movement of the lever may rotate the internal locking mechanisms. Rotation of the internal locking mechanisms may engage a locked or unlocked position. The locking mechanism may be coupled to the lock attachment of a sidewall.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description and are not intended as a definition of the limits of the invention. As used in the specification and in the claims, the singular form of "a," "an," and "the" include plural referents unless the context clearly dictates otherwise

DETAILED DESCRIPTION

Figure 16:
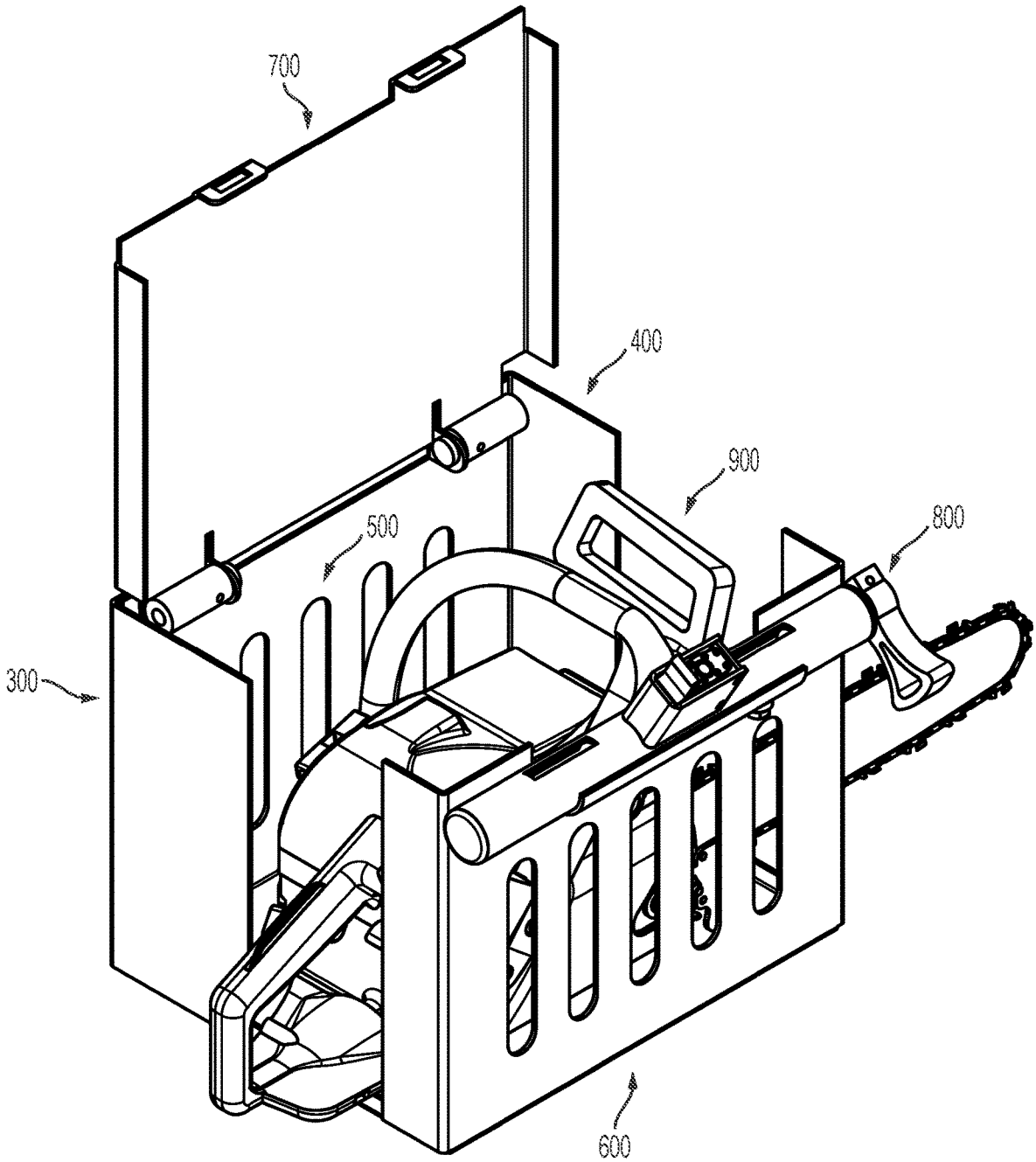
FIG. 16 is a three-dimensional diagram illustrating the first isometric view of the equipment locking system with an opened anti-intrusion lid and a piece of equipment placed in the equipment locking system, in accordance with one or more implementations.
Figure 17:
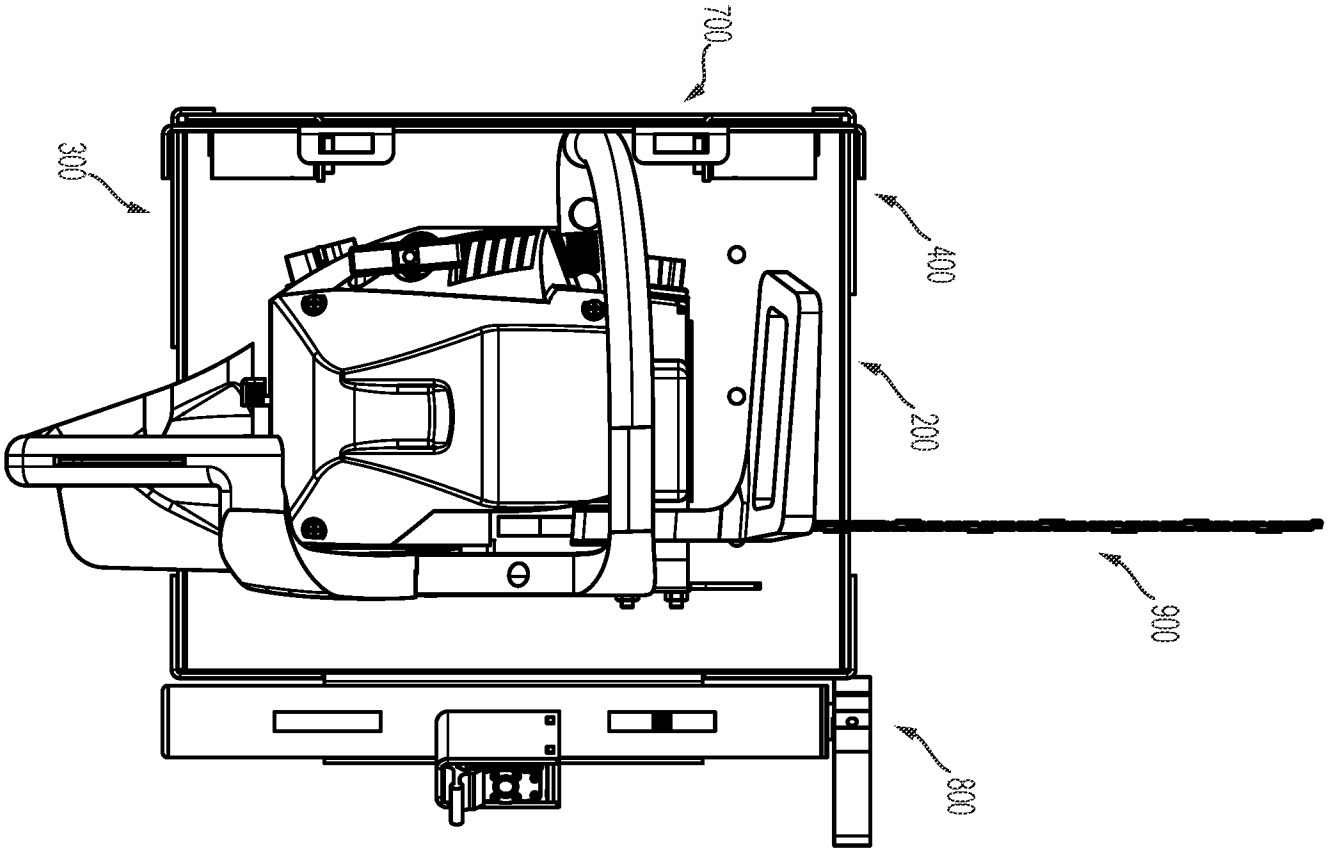
FIG. 17 is a three-dimensional diagram illustrating the top view of the equipment locking system with an opened anti-intrusion lid and a piece of equipment placed in the equipment locking system, in accordance with one or more implementations.
Figure 18:
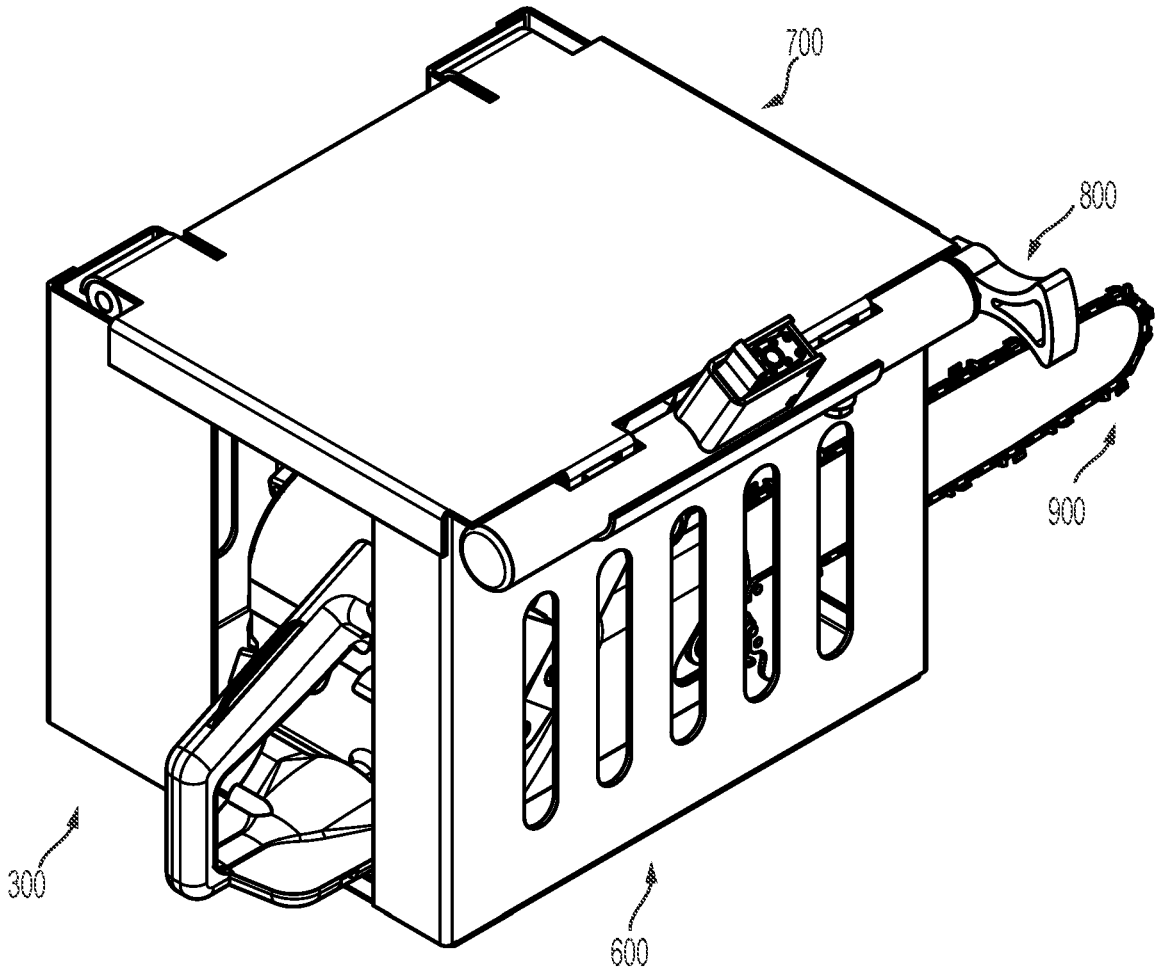
FIG. 18 is a three-dimensional diagram illustrating the first isometric view of the equipment locking system with the closed anti-intrusion lid and a piece of equipment placed in the equipment locking system, in accordance with one or more implementations.

FIGS. 1 to 8 and FIGS. 16 to 18 illustrates a base container 100. Base container 100 may form a partial enclosure. The partial enclosure formed by base container 100 may be configured to at least partially enclose a piece of equipment 900 within base container 100 (as illustrated in FIGS. 16 to 18). Equipment 900 (as depicted in FIGS. 16-18) having a handle and a functional end opposite the handle. Referring to FIG. 16, equipment 900 may sit in base container 100. Referring to FIG. 18, equipment 900 may be fastened, enclosed, restrained, and/or secured within base container 100. Rotatable anti-intrusion lid 700 may be rotated in a closed positioned to prevent equipment 900 from being removed from base container 100 (as depicted in FIG. 18). Portions of equipment 900 may protrude out from base container 100. Equipment 900 may be a chainsaw, handsaw, jackhammer, leaf blower, and/or other equipment.

Figure 1:
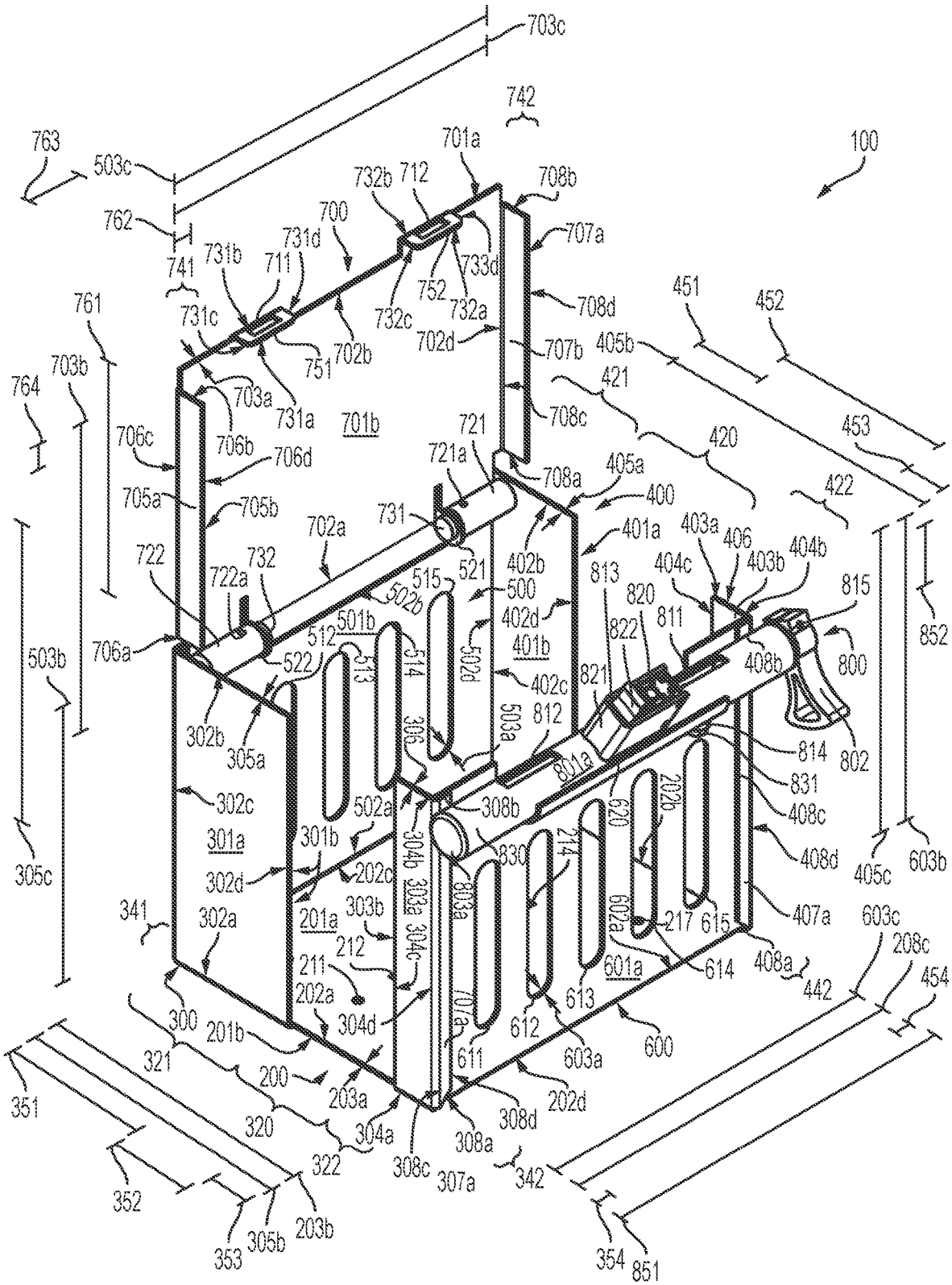
FIG. 1 is a three-dimensional diagram illustrating a first isometric view of an equipment locking system with an opened anti-intrusion lid, in accordance with one or more implementations.

Referring to FIG. 1, base container 100 including one or more of a bottom wall 200, a set of sidewalls, a rotatable anti-intrusion lid 700, a locking mechanism 800, and/or other components. The set of sidewalls may include a first sidewall 300, a second sidewall 400, a third sidewall 500, a fourth sidewall 600, and/or other sidewalls. The individual sidewalls of the set of sidewalls may traverse bottom wall 200 along bottom wall 200's perimeter. Rotatable anti-intrusion lid 700 may be removably coupled to third sidewall 500. The bottom wall 200, the set of sidewalls, and/or rotatable anti-intrusion lid 700 may be joined together to form a partial enclosure.

Referring to FIG. 18, the partial enclosure formed by the bottom wall 200, the set of sidewalls, and/or rotatable anti-intrusion lid 700 may restrict rotation of equipment 900 with respect to one or more axes or rotation. By way of non-limiting example, base container 100 may prevent equipment 900 from rotating in a longitudinal axis, a latitudinal axis, and/or other axes when equipment 900 is within base container 100. The partial enclosure formed by bottom wall 200, the set of sidewalls, and/or rotatable anti-intrusion lid 700 may restrict movement of equipment 900 with respect to one or more directions. By way of non-limiting example, base container 100 may prevent equipment 900 from sliding forward, backward, and/or toward the side. Base container 100 with rotatable anti-intrusion lid 700 in a closed position may prevent equipment 900 from being removed from base container 100. Rotatable anti-intrusion lid 700 in a closed position may prevent equipment 900 from being pulled out of base container 100. Base container 100 with rotatable anti-intrusion lid 700 in a closed position may secure equipment 900 in a fixed location within base container 100.

Rotatable anti-intrusion lid 700 in a closed position may prevent access to equipment 900. Preventing access to equipment 900 includes preventing operation of equipment 900, access to control for operating equipment 900, removal of equipment 900. For example, base container 100 with rotatable anti-intrusion lid 700 in a closed position may prevent a user from access controls for turning on equipment 900.

Referring to FIG. 1, the components of base container 100 may comprise of one or more materials. The one or more materials include one or more of a metal, wood, plastic, carbon fiber, composites, and/or other materials. For example, bottom wall 200, the set of sidewalls, rotatable anti-intrusion lid 700, locking mechanism 800, and/or other components of base container 100 may be made of the one or more materials. In some implementations, the components of base container 100 may comprise of the same material and/or different materials. For example, bottom wall 200, the set of sidewalls, rotatable anti-intrusion lid 700, locking mechanism 800, and/or other components of base container 100 may comprise of metal or another material. In some implementations, components of base container 100 may comprise the same metal and/or different metals. For example, bottom wall 200, the set of sidewalls, rotatable anti-intrusion lid 700 may comprise of a first metal, and locking mechanism 800, and/or other components of base container 100 may comprise of a second metal. By way of non-limiting example, the first metal may be aluminum and the second metal may be steel. In some implementations, the components of base container 100 may be made of a combination of the one or more materials. For example, bottom wall 200, the set of sidewalls, rotatable anti-intrusion lid 700, locking mechanism 800, and/or other components of base container 100 may comprise of metal and plastics, or other combination of materials.

In some implementations, base container 100 including bottom wall 200, the set of sidewalls, rotatable anti-intrusion lid 700, and/or other components may be made of a single piece of material. For example, base container 100 including bottom wall 200, the set of sidewalls, rotatable anti-intrusion lid 700, and/or other components may be made of a single sheet of metal and/or other materials. For example, bottom wall 200 and the set of sidewalls may be shaped or folded into the shape of a portion of base container 100 from a single sheet of metal (e.g., the portion of base container 100 without rotatable anti-intrusion lid 700 and locking mechanism 800). The single piece of material may comprise of the one or more materials. For example, the single piece of material may be metal, plastic, carbon fiber, composites, and/or other materials.

In some implementations, the one or more components of base container 100 may be coupled to one another by one or more couplings. In some implementations, bottom wall 200, the set of sidewalls, and/or other components of base container 100 may be coupled together by the one or more couplings. The one or more couplings includes one or more fasteners, welds, adhesives, and/or other methods for coupling one or more components together. The one or more fasteners may be one or more of one or more screws, one or more rivets, and/or other fasteners. The one or more welds may be one or more of a weld to join two or more pieces of materials (e.g., metal) together. The one or more adhesives may be one or more of glue, cement, epoxy resin, and/or other adhesives.

The individual components of base container 100 comprises a solid body having one or more surfaces, one or more edges, and/or other components. The solid body may have a rectangular shape, a substantially rectangular shape, and/or other shapes. The solid body may have at least 2 surfaces. The solid body may have at least 4 edges. For example, bottom wall 200, the set of sidewalls, rotatable anti-intrusion lid 700, and/or other components may comprise of an individual solid body having one or more surfaces and/or one or more edges.

As illustrated in FIG. 1, bottom wall 200 may be a solid body with a rectangular shape, a substantially rectangular shape, and/or other shapes. The solid body of bottom wall 200 may comprise one or more surfaces, one or more edges, one or more fastener openings, and/or other components. The one or more surfaces may include a first surface 201*a*, a second surface 201*b*, and/or other surfaces. First surface 201*a* may be the opposite surface of second surface 201*b*. The one or more edges may include a first edge 202*a*, a second edge 202*b*, a third edge 202*c*, a fourth edge 202*d*, and/or other edges. First edge 202*a* may be the opposite edge of second edge 202*b*. Third edge 202*c* may be the opposite edge of fourth edge 202*d*. The one or more fastener openings may include an opening 211, an opening 212, an opening 213, an opening 214, an opening 215, an opening 216, an opening 217, an opening 218, an opening 219, and/or other openings.

The individual fastener openings may communicate through the solid body of bottom wall 200 from first surface 201*a* to second surface 201*b*. The individual fastener openings may be located within the boundaries and/or perimeter of bottom wall 200. The individual fastener openings may be one or more of one or more cutaways, one or more apertures, and/or other openings.

The individual fastener openings may have the same shape and/or a different shape. In some implementations, the individual fastener openings may be in a circular shape, a rectangular shape, and/or other shapes. In some implementations, opening 211, opening 215, opening 216, opening 217, opening 218, opening 219, and/or other openings may be in a circular shape. In some implementations, opening 212, opening 213, opening 214, and/or other openings may be in a rectangular shape.

In some implementations, the individual fastener openings may be receptacles configured to receive one or more fasteners and/or other coupling devices. The individual fastener openings may be configured to facilitate one or more of couplings between bottom wall 200 and one or more surfaces, equipment, and/or other physical objects. For example, the individual fastener openings may be configured to facilitate coupling between bottom wall 200 and a vehicle and/or other physical objects. A fastener may be inserted through individual fastener openings to couple the bottom wall 200 to the vehicle and/or other physical objects. The coupling of bottom wall 200 to a physical object may restrict movement of bottom wall 200 relative to the physical object. The coupling of bottom wall 200 to a physical object may restrict movement of base container 100 relative to the physical object.

In some implementations, the individual fastener openings may be positioned in one or more patterns on bottom wall 200. In a non-limiting example, some of the fastener openings may be aligned in one or more of a circular pattern, angular pattern, rectangular pattern, and/or other patterns. Some of the fastener openings may be aligned along the edges and/or close to the edges of bottom wall 200. Some of the fastener openings may be aligned along a center of bottom wall 200. The individual fastener openings may be aligned in one or more lines on bottom wall 200.

Figure 6:
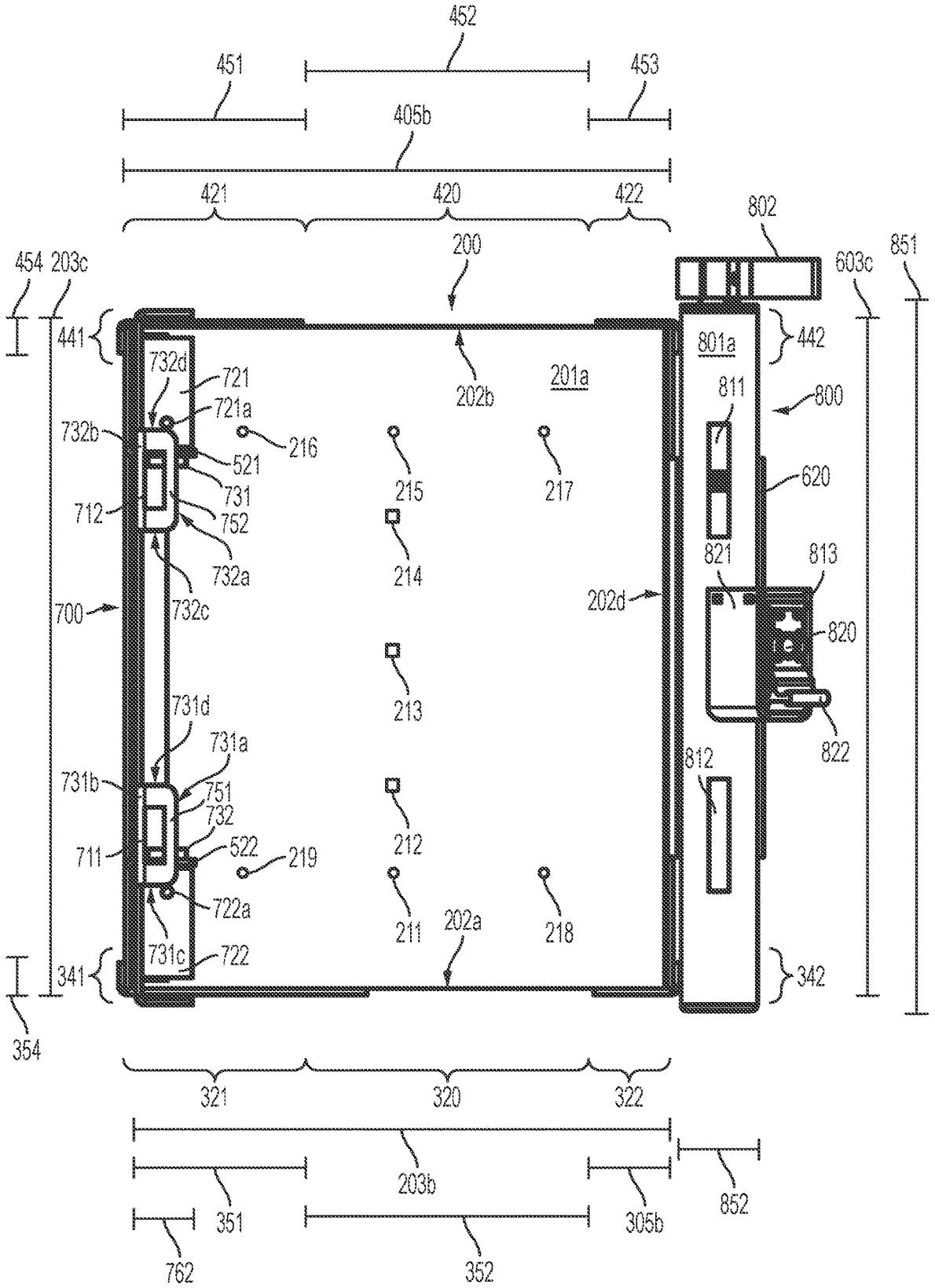
FIG. 6 is a three-dimensional diagram illustrating a top view of the equipment locking system with the opened anti-intrusion lid, in accordance with one or more implementations.

Referring to FIG. 6, for example, opening 215, opening 216, and opening 217 may be aligned along a first line. Opening 215, opening 216, and opening 217 may be evenly spaced aligned along the first line. Opening 211, opening 218, and opening 219 may be aligned along a second line. Opening 211, opening 218, and opening 219 may be evenly spaced along the second line. Opening 211, opening 212, opening 213, opening 214, and opening 215 may be aligned along a third line. Opening 211, opening 212, opening 213, opening 214, and opening 215 may be evenly spaced along the third line. Opening 213 may be located at the center of base wall 200.

The first line and the second line may be parallel to one another. The third line may be orthogonal to the first line and the second line. The third line may intersect the first line and the second line. The third line may intersect the first line and the second line at the middle of the first line and the second line.

Referring back to FIG. 1, in some implementations, bottom wall 200 may be sized to support and/or enclose equipment 900. For example, bottom wall 200 may be defined by one or more of a length 203*c*, a width 203*b*, a thickness 203*a*, and/or other measurements. In some implementations, length 203*c* may be in the range of 300 millimeters (mm) to 400 mm. In some implementations, length 203*c* may be in the range of 320 mm to 380 mm. In some implementations, length 203*c* may be in the range of 340 mm to 370 mm. In some implementations, length 203*c* may be in the range of 350 mm to 365 mm. In some implementations, length 203*c* may be 361.8 mm and/or other measurements. In some implementations, width 203*b* may be in the range of 200 mm to 400 mm. In some implementations, width 203*b* may be in the range of 230 mm to 370 mm. In some implementations, width 203*b* may be in the range of 260 mm to 330 mm. In some implementations, width 203*b* may be in the range of 290 mm to 300 mm. In some implementations, width 203*b* may be 289 mm and/or other measurements. In some implementations, thickness 203*a* may be in the range of 1 mm to 10 mm. In some implementations, thickness 203*a* may be in the range of 3 mm to 7 mm. In some implementations, thickness 203*a* may be in the range of 4 mm to 6 mm. In some implementations, thickness 203*a* may be 5 mm and/or other measurements.

The individual sidewalls of the set of sidewalls may be a solid body with a rectangular shape, a substantially rectangular shape, and/or other shapes. The solid body of the individual sidewalls may comprise of one or more surfaces, one or more edges, one or more anti-intrusion lips, one or more air vents, one or more fastener openings, one or more equipment accommodation gaps, one or more hinges, a lock attachment, and/or other components.

The anti-intrusion lip may be a part of the sidewall that prevents tampering of the equipment enclosed in the base container. The anti-intrusion lip of a given sidewall may overlap a surface of the other sidewalls and/or base wall 200. The air vents may be a structure with an opening that enables the flow of air. The fastener openings may be a structure with one or more openings for a fastener to be insert through the opening such that the fastener may fasten the sidewalls to a physical object. The equipment accommodation gaps may be a structure with an opening that enables portions of the equipment to extend/protrude from within based container 100.

First sidewall 300 may be a solid body with a rectangular shape, a substantially rectangular shape, and/or other shapes. The solid body of first sidewall 300 may comprise one or more surfaces, one or more edges, one or more anti-intrusion lips, one or more equipment accommodation gaps, and/or other components. The equipment accommodation gaps may be a cutaway of first sidewall 300. The equipment accommodation gaps may be a rectangular or a substantially rectangular cutaway of first sidewall 300. The equipment accommodation gaps may split first sidewall 300 into two portions. The equipment accommodation gaps may be a cutaway from an edge to an opposite edge. For example, an equipment accommodation gap 320 may separate or split the solid body of first sidewall 300 into two parts. The two parts of the first sidewall 300 created by equipment accommodation gap 320 may include a first sidewall portion 321, a second sidewall portion 322, and/or other parts. In some implementations, equipment accommodation gap 320 may be configured to accommodate a handle of an equipment (such as a handle of equipment 900 as illustrated in FIG. 16). In some implementations, equipment accommodation gap 320 may be referred to as a handle-accommodation gap. First sidewall portion 321 and/or second sidewall portion 322 may comprise one or more surfaces, one or more edges, one or more anti-intrusion lips, and/or other components.

In some implementations, first sidewall portion 321 and/or second sidewall portion 322 may make up first sidewall 300. First sidewall portion 321 and second sidewall portion 322 may be positioned along the perimeter of base wall 200 such that there may be a gap between first sidewall portion 321 and second sidewall portion 322. The gap between first sidewall portion 321 and second sidewall may be equipment accommodation gap 320.

In some implementations, first sidewall 300 may be sized to support and/or enclose equipment 900. For example, first sidewall 300 may be defined by one or more of a length 305*c*, a width 305*b*, a thickness 305*a*, and/or other measurements. In some implementations, length 305*c* may be in the range of 200 mm to 350 mm. In some implementations, length 305*c* may be in the range of 220 mm to 330 mm. In some implementations, length 305*c* may be in the range of 220 mm to 300 mm. In some implementations, length 305*c* may be 283.2 mm and/or other measurements. In some implementations, width 305*b* may be in the range of 200 mm to 400 mm. In some implementations, width 305*b* may be in the range of 230 mm to 370 mm. In some implementations, width 305*b* may be in the range of 260 mm to 330 mm. In some implementations, width 305*b* may be in the range of 290 mm to 300 mm. In some implementations, width 305*b* may be 289 mm and/or other measurements. In some implementations, thickness 305*a* may be in the range of 1 mm to 10 mm. In some implementations, thickness 305*a* may be in the range of 3 mm to 7 mm. In some implementations, thickness 305*a* may be in the range of 4 mm to 6 mm. In some implementations, thickness 305*a* may be 5 mm and/or other measurements.

Figure 2:
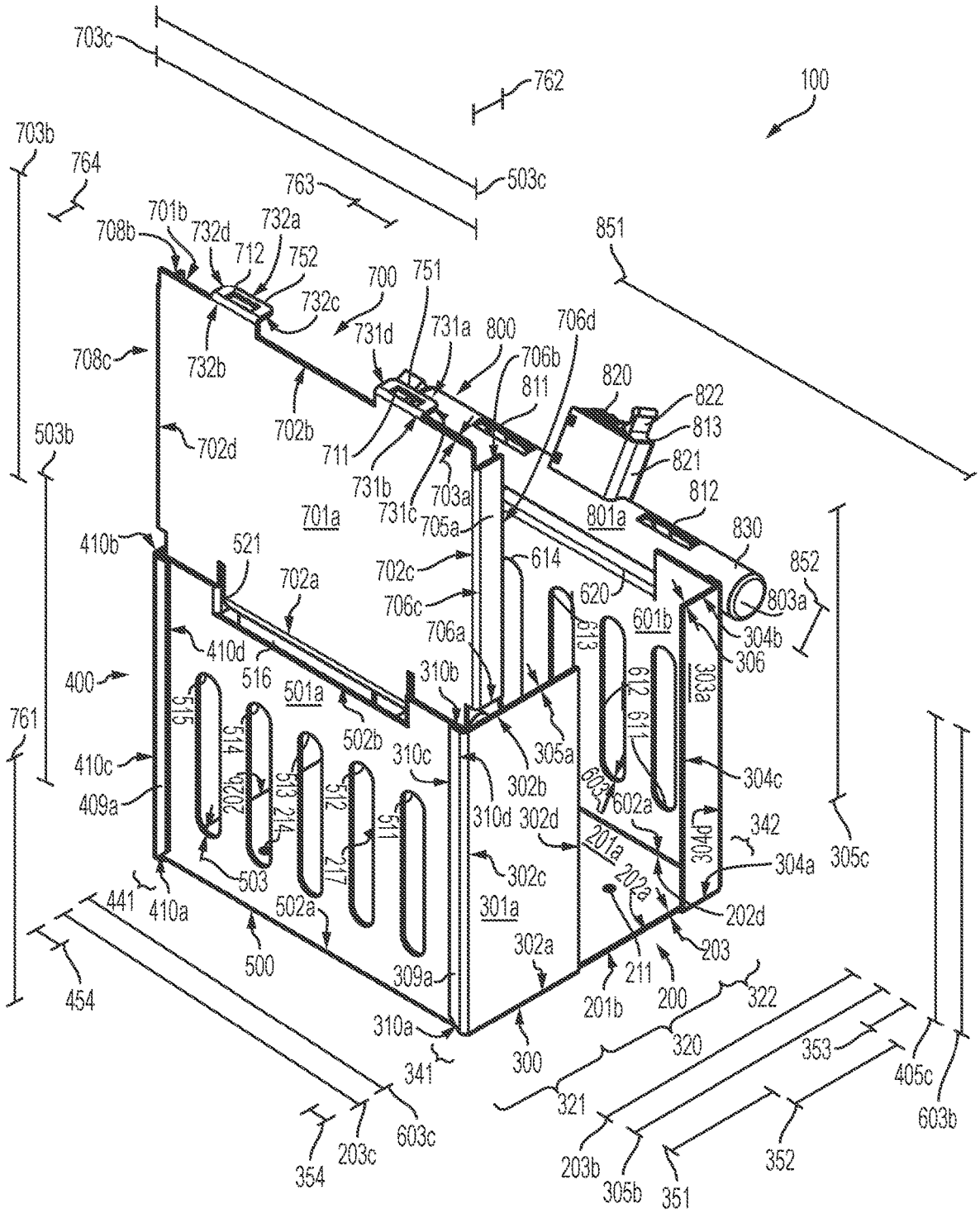
FIG. 2 is a three-dimensional diagram illustrating a second isometric view of the equipment locking system with the opened anti-intrusion lid, in accordance with one or more implementations.

Referring to FIG. 2, first sidewall portion 321 may be a solid body with a rectangular shape, a substantially rectangular shape, and/or other shapes. First sidewall portion 321 may comprise one or more surfaces, one or more edges, one or more anti-intrusion lips, and/or other components. The one or more anti-intrusion lips of first side wall portion 321 may traverse first side wall portion 321. The one or more surfaces of first sidewall portion 321 may include a first portion first surface 301*a*, a first portion second surface 301*b*, and/or other surfaces. First portion first surface 301*a* may be the opposite surface of first portion second surface 301*b*. The one or more edges of first sidewall portion 321 may include a first portion first edge 302*a*, a first portion second edge 302*b*, a first portion third edge 302*c*, a first portion fourth edge 302*d*, and/or other edges. First portion first edge 302*a* may be the opposite edge of first portion second edge 302*b*. First portion third edge 302*c* may be the opposite edge of first portion fourth edge 302*d*. The one or more anti-intrusion lips of the first sidewall portion 321 may include a first anti-intrusion lip 341 and/or other anti-intrusion lips. In some implementations, first anti-intrusion lip 341 may overlap portions of third sidewall 500. In some implementations, first sidewall portion 321 may include an anti-intrusion lip that overlaps portions of base wall 200. The anti-intrusion lip that overlap portions of base wall 200 may be positioned along first portion first edge 302*a*.

First anti-intrusion lip 341 may include one or more surfaces, one or more edges, and/or other components. The one or more surfaces of first anti-intrusion lip 341 may include a first anti-intrusion lip first surface 309*a*, a first anti-intrusion lip second surface 309*b*, and/or other surfaces. First anti-intrusion lip first surface 309*a* may be the opposite surface of first anti-intrusion lip second surface 309*b*. In some implementations, first anti-intrusion lip first surface 309*a* may be an extension of first portion first surface 301*a*, and first anti-intrusion lip second surface 309*b* may be an extension of first portion second surface 301*b*. The one or more edges of first anti-intrusion lip 341 may include a first anti-intrusion lip first edge 310*a*, a first anti-intrusion lip second edge 310*b*, a first anti-intrusion lip third edge 310*c*, a first anti-intrusion lip fourth edge 310*d*, and/or other edges. First anti-intrusion lip first edge 310*a* may be the opposite edge of first anti-intrusion lip second edge 310*b*. First anti-intrusion lip third edge 310*c* may be the opposite edge of first anti-intrusion lip fourth edge 310*d*. First anti-intrusion lip 341 may be joined with or coupled to first sidewall portion 321. In some implementations, fifth anti-intrusion lip third edge 706*c* may share an edge with third edge 702*c*. The shared edge between fifth anti-intrusion lip third edge 706*c* and third edge 702*c* may form a corner.

In some implementations, first sidewall portion 321 may be sized to support and/or enclose equipment 900. For example, first sidewall portion 321 may be defined by one or more of length 305*c*, a width 351, thickness 305*a*, and/or other measurements. In some implementations, width 351 may be in the range of 30 mm to 60 mm mm. In some implementations, width 351 may be in the range of 40 mm to 60 mm. In some implementations, width 351 may be in the range of 50 mm to 60 mm. In some implementations, width 351 may be 54 mm.

In some implementations, first anti-intrusion lip 341 may be defined by one or more of length 305*c*, a width 354, thickness 305*a*, and/or other measurements. In some implementations, width 354 may be in the range of 10 mm to 20 mm. In some implementations, width 354 may be in the range of 12 mm to 18 mm. In some implementations, width 354 may be in the range of 15 mm to 17 mm. In some implementations, width 354 may be 16.2 mm and/or other measurements.

Referring to FIG. 1, second sidewall portion 322 may be a solid body with a rectangular shape, a substantially rectangular shape, and/or other shapes. Second sidewall portion 322 may comprise one or more surfaces, one or more edges, one or more anti-intrusion lips, and/or other components. The one or more anti-intrusion lips of second sidewall portion 322 may traverse second sidewall portion 322. The one or more surfaces of second sidewall portion 322 may include a second portion first surface 303*a*, a second portion second surface 303*b*, and/or other surfaces. Second portion first surface 303*a* may be the opposite surface of second portion second surface 303*b*. The one or more edges of second sidewall portion 322 may include a second portion first edge 304*a*, a second portion second edge 304*b*, a second portion third edge 304*c*, a second portion fourth edge 304*d*, and/or other edges. Second portion first edge 304*a* may be the opposite edge of second portion second edge 304*b*. Second portion third edge 304*c* may be the opposite edge of second portion fourth edge 304*d*. The one or more anti-intrusion lips of the second sidewall portion 322 may include a second anti-intrusion lip 342 and/or other anti-intrusion lips. In some implementations, second anti-intrusion lip 342 may overlap portions of fourth sidewall 600. In some implementations, second sidewall portion 322 may include an anti-intrusion lip that overlaps portions of base wall 200. The anti-intrusion lip that overlap portions of base wall 200 may be positioned along second portion first edge 304*a*.

Second anti-intrusion lip 342 may include one or more surfaces, one or more edges, and/or other components. The one or more surfaces of second anti-intrusion lip 342 may include a second anti-intrusion lip first surface 307*a*, a second anti-intrusion lip second surface 307*b* (not depicted in FIG. 1), and/or other surfaces. Second anti-intrusion lip first surface 307*a* may be the opposite surface of second anti-intrusion lip second surface 307*b*. In some implementations, second anti-intrusion lip first surface 307*a* may be an extension of second portion first surface 303*a*, and second anti-intrusion lip second surface 307*b* may be an extension of second portion second surface 303*b*. The one or more edges of second anti-intrusion lip 341 may include a second anti-intrusion lip first edge 308*a*, a second anti-intrusion lip second edge 308*b*, a second anti-intrusion lip third edge 308*c*, a second anti-intrusion lip fourth edge 308*d*, and/or other edges. Second anti-intrusion lip first edge 308*a* may be the opposite edge of second anti-intrusion lip second edge 308*b*. Second anti-intrusion lip third edge 308*c* may be the opposite edge of second anti-intrusion lip fourth edge 308*d*. Second anti-intrusion lip 342 may be joined with or coupled to second sidewall portion 322. In some implementations, second anti-intrusion lip third edge 308*c* may share an edge with fourth edge 304*d*. The shared edge between second anti-intrusion lip third edge 308*c* and fourth edge 304*d* may form a corner.

In some implementations, second sidewall portion 322 may be sized to support and/or enclose equipment 900. For example, second sidewall portion 322 may be defined by one or more of length 305*c*, a width 353, a thickness 306, and/or other measurements. In some implementations, width 353 may be in the range of 50 mm to 150 mm. In some implementations, width 353 may be in the range of 60 mm to 120 mm. In some implementations, width 353 may be in the range of 80 mm to 100 mm. In some implementations, width 353 may be in the range of 90 mm to 100 mm. In some implementations, width 353 may be 98 mm and/or other measurements. In some implementations, thickness 306 may be in the range of 1 mm to 10 mm. In some implementations, thickness 306 may be in the range of 3 mm to 7 mm. In some implementations, thickness 306 may be in the range of 4 mm to 6 mm. In some implementations, thickness 306 may be 5 mm and/or other measurements. In some implementations, second anti-intrusion lip 342 may be defined by one or more of length 305*c*, width 353, thickness 306, and/or other measurements.

In some implementations, equipment accommodation gap 320 may be defined by one or more of length 305*c*, a width 352, and/or other measurements. In some implementations, width 352 may be in the range of 100 mm to 200 mm. In some implementations, width 352 may be in the range of 120 mm to 180 mm. In some implementations, width 352 may be in the range of 130 mm to 170 mm. In some implementations, width 352 may be in the range of 140 mm to 160 mm. In some implementations, width 352 may be 146 mm and/or other measurements. In some implementations, the width 352 may be ¾$^{th}$ of the width of width 452.

Second sidewall 400 may be a solid body with a rectangular shape, a substantially rectangular shape, and/or other shapes. The solid body of second sidewall 400 may comprise one or more surfaces, one or more edges, one or more anti-intrusion lips, one or more equipment accommodation gaps, and/or other components. The equipment accommodation gaps may be a cutaway of second sidewall 400. The equipment accommodation gaps may be a rectangular or a substantially rectangular cutaway of second sidewall 400. The equipment accommodation gaps may split second sidewall 400 into two portions. The equipment accommodation gaps may be a cutaway from an edge to an opposite edge. For example, an equipment accommodation gap 420 may separate or split the solid body of second sidewall 400 into two parts. The two parts of the second sidewall 400 created by equipment accommodation gap 420 may include a third sidewall portion 421, a fourth sidewall portion 422, and/or other parts. In some implementations, equipment accommodation gap 420 may be configured to accommodate a functional-end of an equipment (such as a functional-end of equipment 900 as illustrated in FIG. 16). In some implementations, equipment accommodation gap 420 may be referred to as a functional-end-accommodation gap. Third sidewall portion 421 and/or fourth sidewall portion 422 may comprise one or more surfaces, one or more edges, one or more anti-intrusion lips, and/or other components. In some implementations, second sidewall 400 may be similar to first sidewall 300, but position on an opposite edge to first sidewall 300 of base sidewall 200.

In some implementations, third sidewall portion 421 and/or fourth sidewall portion 422 may make up second sidewall 400. Third sidewall portion 421 and fourth sidewall portion 422 may be positioned along the perimeter of base wall 200 such that there may be a gap between third sidewall portion 421 and fourth sidewall portion 422. The gap between third sidewall portion 421 and second sidewall may be equipment accommodation gap 420.

In some implementations, second sidewall 400 may be sized to support and/or enclose equipment 900. For example, second sidewall 400 may be defined by one or more of a length 405*c*, a width 405*b*, a thickness 405*a*, and/or other measurements. In some implementations, length 405*c* may be in the range of 200 mm to 350 mm. In some implementations, length 405*c* may be in the range of 220 mm to 330 mm. In some implementations, length 405*c* may be in the range of 220 mm to 300 mm. In some implementations, length 405*c* may be 283.2 mm and/or other measurements. In some implementations, width 405*b* may be in the range of 200 mm to 400 mm. In some implementations, width 405*b* may be in the range of 230 mm to 370 mm. In some implementations, width 405*b* may be in the range of 260 mm to 330 mm. In some implementations, width 405*b* may be in the range of 290 mm to 300 mm. In some implementations, width 405*b* may be 289 mm and/or other measurements. In some implementations, thickness 405*a* may be in the range of 1 mm to 10 mm. In some implementations, thickness 405*a* may be in the range of 3 mm to 7 mm. In some implementations, thickness 405*a* may be in the range of 4 mm to 6 mm. In some implementations, thickness 405*a* may be 5 mm and/or other measurements.

Third sidewall portion 421 may be a solid body with a rectangular shape, a substantially rectangular shape, and/or other shapes. Third sidewall portion 421 may comprise one or more surfaces, one or more edges, one or more anti-intrusion lips, and/or other components. The one or more anti-intrusion lips of third sidewall portion 421 may traverse the third sidewall portion 421. The one or more surfaces of third sidewall portion 421 may include a third portion first surface 401*a*, a third portion second surface 401*b*, and/or other surfaces. Third portion first surface 401*a* may be the opposite surface of third portion second surface 401*b*. The one or more edges of third sidewall portion 421 may include a third portion first edge 402*a*, a third portion second edge 402*b*, a third portion third edge 402*c*, a third portion fourth edge 402*d*, and/or other edges. Third portion first edge 402*a* may be the opposite edge of third portion second edge 402*b*. Third portion third edge 402*c* may be the opposite edge of third portion fourth edge 402*d*. The one or more anti-intrusion lips of the third sidewall portion 421 may include a third anti-intrusion lip 441 (depicted in FIG. 2) and/or other anti-intrusion lips. In some implementations, third anti-intrusion lip 441 may overlap portions of third sidewall 500. In some implementations, third sidewall portion 421 may include an anti-intrusion lip that overlaps portions of base wall 200. The anti-intrusion lip that overlap portions of base wall 200 may be positioned along third portion first edge 402*a* (depicted in FIG. 4).

In some implementations, third sidewall portion 421 may be sized to support and/or enclose equipment 900. For example, third sidewall portion 421 may be defined by one or more of length 405*c*, a width 451, thickness 405*a*, and/or other measurements. In some implementations, width 451 may be in the range of 30 mm to 60 mm. In some implementations, width 451 may be in the range of 40 mm to 60 mm. In some implementations, width 451 may be in the range of 50 mm to 60 mm. In some implementations, width 451 may be 54 mm.

Referring to FIG. 2, third anti-intrusion lip 441 may include one or more surfaces, one or more edges, and/or other components. The one or more surfaces of third anti-intrusion lip 441 may include a third anti-intrusion lip first surface 409*a*, a third anti-intrusion lip second surface 409*b* (not depicted), and/or other surfaces. Third anti-intrusion lip first surface 409*a* may be the opposite surface of third anti-intrusion lip second surface 409*b*. In some implementations, third anti-intrusion lip first surface 409*a* may be an extension of third portion first surface 401*a*, and third anti-intrusion lip second surface 409*b* may be an extension of third portion second surface 401*b*. The one or more edges of third anti-intrusion lip 441 may include a third anti-intrusion lip first edge 410*a*, a third anti-intrusion lip second edge 410*b*, a third anti-intrusion lip third edge 410*c*, a third anti-intrusion lip fourth edge 410*d*, and/or other edges. Third anti-intrusion lip first edge 410*a* may be the opposite edge of third anti-intrusion lip second edge 410*b*. Third anti-intrusion lip third edge 410*c* may be the opposite edge of third anti-intrusion lip fourth edge 410*d*. Third anti-intrusion lip 441 may be joined with or coupled to third sidewall portion 421. In some implementations, third anti-intrusion lip third edge 410*c* may share an edge with third edge 402*c*. The shared edge between third anti-intrusion lip third edge 410*c* and third edge 402*c* may form a corner.

In some implementations, third anti-intrusion lip 441 may be defined by one or more of a length 405*c*, a width 454, a thickness 405*a*, and/or other measurements. In some implementations, width 454 may be in the range of 10 mm to 20 mm. In some implementations, width 454 may be in the range of 12 mm to 18 mm. In some implementations, width 454 may be in the range of 15 mm to 17 mm. In some implementations, width 454 may be 16.2 mm and/or other measurements.

Referring to FIG. 1, fourth sidewall portion 422 may be a solid body with a rectangular shape, a substantially rectangular shape, and/or other shapes. Fourth sidewall portion 422 may comprise one or more surfaces, one or more edges, one or more anti-intrusion lips, and/or other components. The one or more anti-intrusion lips of fourth sidewall portion 422 may traverse fourth sidewall portion 422. The one or more surfaces of fourth sidewall portion 422 may include a fourth portion first surface 403*a*, a fourth portion second surface 403*b*, and/or other surfaces. Fourth portion first surface 403*a* may be the opposite surface of fourth portion second surface 403*b*. The one or more edges of fourth sidewall portion 422 may include a fourth portion first edge 404*a*, a fourth portion second edge 404*b*, a fourth portion third edge 404*c*, a fourth portion fourth edge 404*d*, and/or other edges. Fourth portion first edge 404*a* may be the opposite edge of fourth portion second edge 404*b*. Fourth portion third edge 404*c* may be the opposite edge of fourth portion fourth edge 404*d*. The one or more anti-intrusion lips of the fourth sidewall portion 422 may include a fourth anti-intrusion lip 442 and/or other anti-intrusion lips. In some implementations, fourth anti-intrusion lip 442 may overlap portions of fourth sidewall 600. In some implementations, fourth sidewall portion 422 may include an anti-intrusion lip that overlaps portions of base wall 200. The anti-intrusion lip that overlap portions of base wall 200 may be positioned along second portion fourth portion first edge 404*a*.

Fourth anti-intrusion lip 442 may include one or more surfaces, one or more edges, and/or other components. The one or more surfaces of fourth anti-intrusion lip 442 may include a fourth anti-intrusion lip first surface 407*a*, a fourth anti-intrusion lip second surface 407*b*, and/or other surfaces. In some implementations, fourth anti-intrusion lip first surface 407*a* may be an extension of first portion first surface 403*a*, and fourth anti-intrusion lip second surface 407*b* (the opposite surface of first portion first surface 403*a* and not depicted) may be an extension of first portion second surface 403*b*. In other words, fourth anti-intrusion lip first surface 407*a* and first portion first surface 403*a* may share a surface, and fourth anti-intrusion lip second surface 407*b* and first portion second surface 403*b* may share a surface. The one or more edges of fourth anti-intrusion lip 442 may include a fourth anti-intrusion lip first edge 408*a*, a fourth anti-intrusion lip second edge 408*b*, a fourth anti-intrusion lip third edge 408*c*, a fourth anti-intrusion lip fourth edge 408*d*, and/or other edges. Fourth anti-intrusion lip first edge 408*a* may be the opposite edge of fourth anti-intrusion lip second edge 408*b*. Fourth anti-intrusion lip third edge 408*c* may be the opposite edge of fourth anti-intrusion lip fourth edge 408*d*. Fourth anti-intrusion lip 442 may be joined with or coupled to fourth sidewall portion 422. In some implementations, fourth anti-intrusion lip third edge 408*c* may share an edge with third edge 404*c*. The shared edge between fourth anti-intrusion lip third edge 408*c* and third edge 404*c* may form a corner.

In some implementations, fourth sidewall portion 422 may be sized to support and/or enclose equipment 900. For example, fourth sidewall portion 422 may be defined by one or more of length 405*c*, a width 453, a thickness 406, and/or other measurements. In some implementations, width 453 may be in the range of 50 mm to 150 mm. In some implementations, width 453 may be in the range of 60 mm to 120 mm. In some implementations, width 453 may be in the range of 80 mm to 100 mm. In some implementations, width 453 may be in the range of 90 mm to 100 mm. In some implementations, width 453 may be 98 mm and/or other measurements. In some implementations, thickness 406 may be in the range of 1 mm to 10 mm. In some implementations, thickness 406 may be in the range of 3 mm to 7 mm. In some implementations, thickness 406 may be in the range of 4 mm to 6 mm. In some implementations, thickness 406 may be 5 mm and/or other measurements. In some implementations, fourth anti-intrusion lip 442 may be defined by one or more of length 405*c*, width 453, thickness 406, and/or other measurements.

In some implementations, equipment accommodation gap 420 may be defined by one or more of length 405*c*, a width 452, and/or other measurements. In some implementations, width 452 may be in the range of 100 mm to 200 mm. In some implementations, width 452 may be in the range of 120 mm to 180 mm. In some implementations, width 452 may be in the range of 130 mm to 170 mm. In some implementations, width 452 may be in the range of 140 mm to 160 mm. In some implementations, width 452 may be 146 mm and/or other measurements.

Third sidewall 500 may be a solid body with a rectangular shape, a substantially rectangular shape, and/or other shapes. The solid body of third sidewall 500 may comprise of one or more surfaces, one or more edges, one or more fastener openings, one or more air vents, one or more lid attachment structure, and/or other components. The one or more surfaces of third sidewall 500 may include a first surface 501*a* (depicted in FIG. 2), a second surface 501*b*, and/or other surfaces. First surface 501*a* may be the opposite surface of second surface 501*b*. The one or more edges of third sidewall 500 may include a first edge 502*a*, a second edge 502*b*, a third edge 502*c* (depicted in FIG. 9), a fourth edge 502*d*, and/or other edges. First edge 502*a* may be the opposite edge of second edge 502*b*. Third edge 502*c* may be the opposite edge of fourth edge 502*d*. The one or more air vents may include a first air vent 511 (depicted in FIG. 2), a second air vent 512, a third air vent 513, a fourth air vent 514, a fifth air vent 515, and/or other air vents. The one or more lid attachment structure of third sidewall 500 may include a first hinge 521, a second hinge 522, and/or other lid attachment structures.

The individual air vents of third sidewall 500 may communicate through the solid body of third sidewall 500 from first surface 501*a* to second surface 501*b*. The individual air vents may be located within the boundaries and/or perimeter of third sidewall 500. The individual air vents may be one or more of one or more cutaways, one or more apertures, and/or other openings. The one or more air vents may be positioned equal distance apart from one another. The one or more air vents may be in a shape of an oval shape and/or other shapes.

Figure 5:
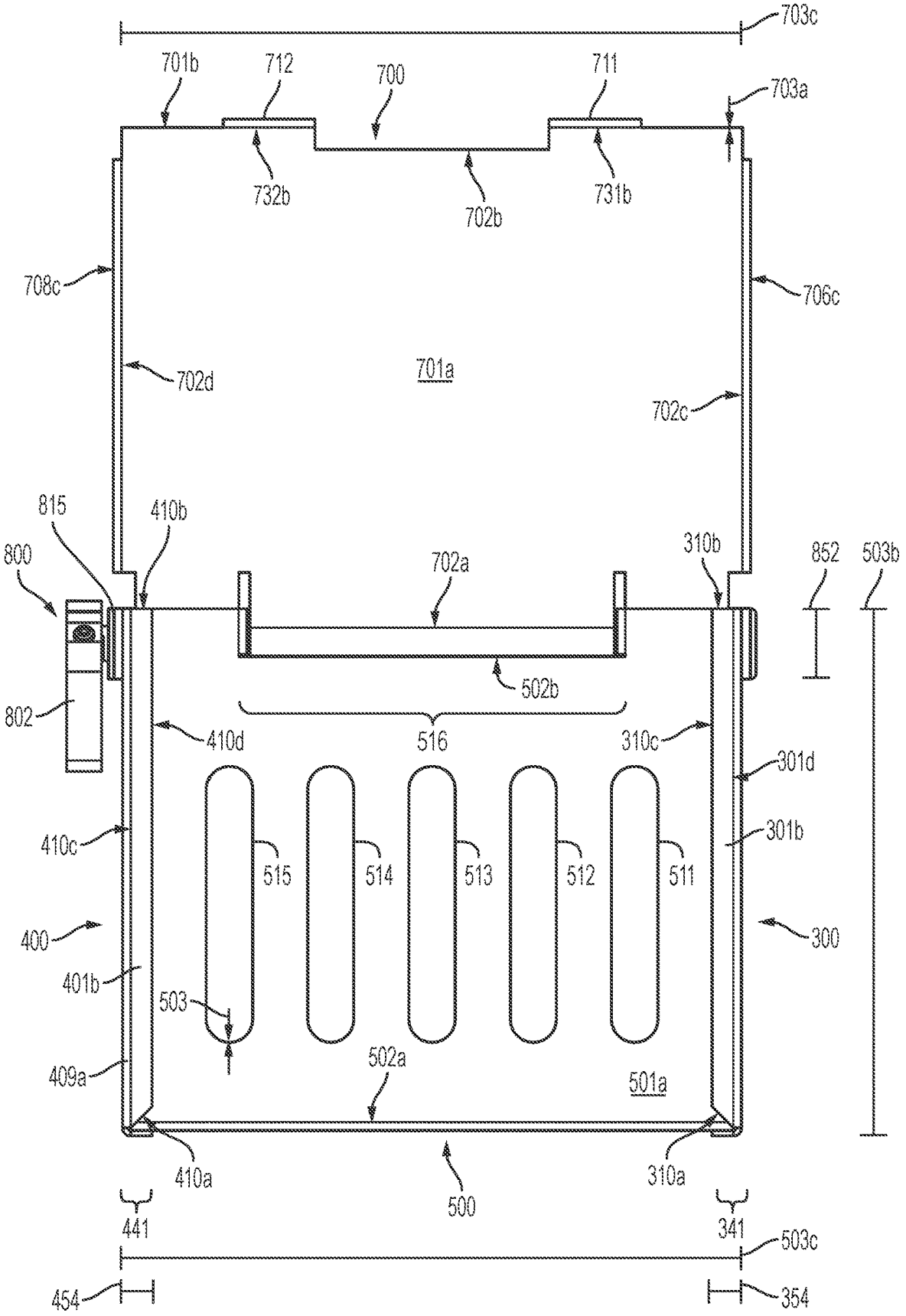
FIG. 5 is a three-dimensional diagram illustrating a backside view of the equipment locking system with the opened anti-intrusion lid, in accordance with one or more implementations.

The solid body of third sidewall 500 may include a cutaway 516 (as illustrated in FIG. 5) for accommodating portions of rotatable anti-intrusion lid 700. Cutaway 516 may remove portion of the solid body of third sidewall 500. Cutaway 516 may communicate through the solid body of third sidewall 516 from first surface 501*a* to second surface 501*b*. Cutaway 516 may communicate through the solid body of third sidewall 500 along the second edge 502*b*. Cutaway 516 may communicate through the solid body of third sidewall 500 at the center of the second edge 502*b*. Cutaway 516 may be a rectangular shape, a substantially rectangular shape, and/or other shapes. First hinge 521 and second hinge 522 may be positioned on the edge of third sidewall 500 near cutaway 516.

In some implementations, third sidewall 500 may be sized to support and/or enclose equipment 900. For example, third sidewall 500 may be defined by one or more of a length 503*c*, a width 503*b*, a thickness 503*a*, and/or other measurements. In some implementations, length 503*c* may be in the range of 320 mm to 380 mm. In some implementations, length 503*c* may be in the range of 340 mm to 370 mm. In some implementations, length 503*c* may be in the range of 350 mm to 365 mm. In some implementations, length 503*c* may be 361.8 mm and/or other measurements. In some implementations, width 503*b* may be in the range of 200 mm to 350 mm. In some implementations, width 503*b* may be in the range of 220 mm to 330 mm. In some implementations, width 503*b* may be in the range of 220 mm to 300 mm. In some implementations, width 503*b* may be 280.9 mm and/or other measurements. In some implementations, thickness 503*a* may be in the range of 1 mm to 10 mm. In some implementations, thickness 503*a* may be in the range of 3 mm to 7 mm. In some implementations, thickness 503*a* may be in the range of 4 mm to 6 mm. In some implementations, thickness 503*a* may be 5 mm and/or other measurements.

Fourth sidewall 600 may be a solid body with a rectangular shape, a substantially rectangular shape, and/or other shapes. The solid body of fourth sidewall 600 may comprise of one or more surfaces, one or more edges, one or more fastener openings, one or more air vents, one or more lock attachments, and/or other components. The one or more surfaces of fourth sidewall 600 may include a first surface 601*a*, a second surface 601*b* (depicted in FIG. 2), and/or other surfaces. First surface 601*a* may be the opposite surface of second surface 601*b*. The one or more edges of fourth sidewall 600 may include a first edge 602*a*, a second edge 602*b* (depicted in FIG. 5), a third edge 602*c* (depicted in FIG. 9), a fourth edge 602*d* (depicted in FIG. 9), and/or other edges. First edge 602*a* may be the opposite edge of second edge 602*b*. Third edge 602*c* may be the opposite edge of fourth edge 602*d*. The one or more air vents may include a first air vent 611, a second air vent 612, a third air vent 613, a fourth air vent 614, a fifth air vent 615, and/or other air vents. The one or more lock attachment of fourth sidewall 600 may include a first lock attachment 620 and/or other lock attachments.

The individual air vents may communicate through the solid body of fourth sidewall 600 from first surface 601*a* to second surface 601*b*. The individual air vents may be located within the boundaries and/or perimeter of fourth sidewall 600. The individual air vents may be one or more of one or more cutaways, one or more apertures, and/or other openings. The one or more air vents may be positioned equal distance apart from one another. The one or more air vents may be in a shape of an oval shape and/or other shapes.

First lock attachment 620 may be formed from a portion of fourth sidewall 600. First lock attachment 620 may include a first surface and a second surface. The first surface may be part of first surface 601*a*. The second surface may be part of second surface 601*b*. First lock attachment 620 may be located along second edge 602*b*. First lock attachment 620 may be folded from the portion of fourth sidewall 600 along second edge 602*b*. First lock attachment 620 may be a drawn cut out of fourth sidewall 600 along second edge 602*b*. First lock attachment 620 may be folded such that first lock attachment 620 may be coupled to locking mechanism 800. First lock attachment 620 may cup locking mechanism 800.

In some implementations, fourth sidewall 600 may be sized to support and/or enclose equipment 900. For example, fourth sidewall 600 may be defined by one or more of a length 603*c*, a width 603*b*, a thickness 603*a*, and/or other measurements. In some implementations, length 603*c* may be in the range of 320 mm to 380 mm. In some implementations, length 603*c* may be in the range of 340 mm to 370 mm. In some implementations, length 603*c* may be in the range of 350 mm to 365 mm. In some implementations, length 603*c* may be 361.8 mm and/or other measurements. In some implementations, width 603*b* may be in the range of 200 mm to 350 mm. In some implementations, width 603*b* may be in the range of 220 mm to 330 mm. In some implementations, width 603*b* may be in the range of 220 mm to 300 mm. In some implementations, width 603*b* may be 280.9 mm and/or other measurements. In some implementations, thickness 603*a* may be in the range of 1 mm to 10 mm. In some implementations, thickness 603*a* may be in the range of 3 mm to 7 mm. In some implementations, thickness 603*a* may be in the range of 4 mm to 6 mm. In some implementations, thickness 603*a* may be 5 mm and/or other measurements.

Rotatable anti-intrusion lid 700 may be a solid body with a rectangular shape, a substantially rectangular shape, and/or other shapes. Rotatable anti-intrusion lid 700 may comprise of one or more surfaces, one or more edges, one or more anti-intrusion lips, one or more lid attachment structures, one or more lock adaptors, one or more cutaways, and/or other components. The one or more anti-intrusion lips, one or more lid attachment structures, one or more lock adaptors, and/or other components of rotatable anti-intrusion lid 700 may traverse rotatable anti-intrusion lid 700. The one or more surfaces of rotatable anti-intrusion lid 700 may include a first surface 701*a* (depicted in FIG. 2), a second surface 701*b*, and/or other surfaces. First surface 701*a* may be the opposite surface of second surface 701*b*. The one or more edges of rotatable anti-intrusion lid 700 may include a first edge 702*a*, a second edge 702*b*, a third edge 702*c* (depicted in FIG. 2), a fourth edge 702*d* (depicted in FIG. 2), and/or other edges. First edge 702*a* may be the opposite edge of second edge 702*b*. Third edge 702*c* may be the opposite edge of fourth edge 702*d*.

The one or more anti-intrusion lips of the rotatable anti-intrusion lid 700 may include a fifth anti-intrusion lip 741 (depicted in FIG. 10), a sixth anti-intrusion lip 742 (depicted in FIG. 10), and/or other anti-intrusion lips. The one or more lid attachment structures includes a first shielded hinge 721, a second shielded hinge 722, and/or other lid attachment structures. The one or more lock adaptors includes a first lock adaptor 711, a second lock adaptor 712, and/or other lock adaptors.

In some implementations, rotatable anti-intrusion lid 700 may be sized to support and/or enclose equipment 900. For example, rotatable anti-intrusion lid 700 may be defined by one or more of a length 703*c*, a width 703*b*, a thickness 703*a*, and/or other measurements. In some implementations, length 703*c* may be in the range of 300 mm to 400 mm. In some implementations, length 703*c* may be in the range of 320 mm to 380 mm. In some implementations, length 703*c* may be in the range of 340 mm to 370 mm. In some implementations, length 703*c* may be in the range of 350 mm to 365 mm. In some implementations, length 703*c* may be 361.8 mm and/or other measurements. In some implementations, width 703*b* may be in the range of 200 mm to 400 mm. In some implementations, width 703*b* may be in the range of 230 mm to 370 mm. In some implementations, width 703*b* may be in the range of 260 mm to 330 mm. In some implementations, width 703*b* may be in the range of 290 mm to 300 mm. In some implementations, width 703*b* may be 289 mm and/or other measurements. In some implementations, thickness 703*a* may be in the range of 1 mm to 10 mm. In some implementations, thickness 703*a* may be in the range of 3 mm to 7 mm. In some implementations, thickness 703*a* may be in the range of 4 mm to 6 mm. In some implementations, thickness 703*a* may be 3 mm and/or other measurements.

Fifth anti-intrusion lip 741 may include one or more surfaces, one or more edges, and/or other components. The one or more surfaces of fifth anti-intrusion lip 741 may include a fifth anti-intrusion lip first surface 705*a*, a fifth anti-intrusion lip second surface 705*b*, and/or other surfaces. Fifth anti-intrusion lip first surface 705*a* may be the opposite surface of fifth anti-intrusion lip second surface 705*b*. In some implementations, fifth anti-intrusion lip first surface 705*a* may be an extension of first portion first surface 701*a*, fifth anti-intrusion lip second surface 705*b* may be an extension of first portion second surface 701*b*. The one or more edges of fifth anti-intrusion lip 741 may include a fifth anti-intrusion lip first edge 706*a*, a fifth anti-intrusion lip second edge 706*b*, a fifth anti-intrusion lip third edge 706*c*, a fifth anti-intrusion lip fourth edge 706*d*, and/or other edges. Fifth anti-intrusion lip first edge 706*a* may be the opposite edge of fifth anti-intrusion lip second edge 706*b*. Fifth anti-intrusion lip third edge 706*c* may be the opposite edge of fifth anti-intrusion lip fourth edge 706*d*. Fifth anti-intrusion lip 741 may be joined with or coupled to rotatable anti-intrusion lid 700 along third edge 702*c*. In some implementations, fifth anti-intrusion lip third edge 706*c* may share an edge with third edge 302*c*. The shared edge between first anti-intrusion lip third edge 310*c* and third edge 302*c* may form a corner. In some implementations, fifth anti-intrusion lip 741 may overlap portions of first sidewall 300.

In some implementations, fifth anti-intrusion lip 741 may be defined by one or more of a length 761, a width 762, thickness 703*a*, and/or other measurements. In some implementations, length 761 may be in the range of 200 to 289 mm. In some implementations, length 761 may be in the range of 150 to 289 mm. In some implementations, length 761 may be in the range of 200 to 289 mm. In some implementations, length 761 may be in the range of 230 to 270 mm. In some implementations, length 761 may be in the range of 240 to 260 mm. In some implementations, length 761 may be 249.2 mm and/or other measurements. In some implementations, width 762 may be in the range of 10 to 50 mm. In some implementations, width 762 may be in the range of 15 to 40 mm. In some implementations, width 762 may be in the range of 15 to 30 mm. In some implementations, width 762 may be in the range of 20 to 30 mm. In some implementations, width 762 may be 28 mm and/or other measurements.

Sixth anti-intrusion lip 742 may include one or more surfaces, one or more edges, and/or other components. The one or more surfaces of sixth anti-intrusion lip 742 may include a sixth anti-intrusion lip first surface 707*a* (depicted in FIG. 4), a sixth anti-intrusion lip second surface 707*b*, and/or other surfaces. Sixth anti-intrusion lip first surface 707*a* may be the opposite surface of sixth anti-intrusion lip second surface 707*b*. In some implementations, sixth anti-intrusion lip first surface 707*a* may be an extension of first portion first surface 701*a*, sixth anti-intrusion lip second surface 707*b* may be an extension of first portion second surface 701*b*. The one or more edges of sixth anti-intrusion lip 742 may include a sixth anti-intrusion lip first edge 708*a*, a sixth anti-intrusion lip second edge 708*b*, a sixth anti-intrusion lip third edge 708*c*, a sixth anti-intrusion lip fourth edge 708*d*, and/or other edges. Sixth anti-intrusion lip first edge 708*a* may be the opposite edge of sixth anti-intrusion lip second edge 708*b*. Sixth anti-intrusion lip third edge 708*c* may be the opposite edge of sixth anti-intrusion lip fourth edge 708*d*. Sixth anti-intrusion lip 742 may be joined with or coupled to rotatable anti-intrusion lid 700 along fourth edge 702*d*. In some implementations, sixth anti-intrusion lip third edge 708*c* may share an edge with third edge 702*c*. The shared edge between sixth anti-intrusion lip third edge 708*c* and third edge 702*c* may form a corner. In some implementations, fifth anti-intrusion lip 742 may overlap portions of second sidewall 400. In some implementations, sixth anti-intrusion lip 742 may be defined by one or more of length 761, width 762, thickness 703*a*, and/or other measurements.

First shielded hinge 721 may be in a shape of a cylinder and/or other shapes. First shielded hinge 721 may be a solid body with the cylinder shape and/or other shapes. First shielded hinge 721 may be in a shape of a hollow cylinder and/or other shapes. First shielded hinge 721 may include a first opening 721*a*, a second opening 721*b* (depicted in FIG. 10), and/or other openings. Second opening 721*b* may communicate through the top to the bottom of the cylinder of first shielded hinge 721. Second opening 721*b* may be a circular opening and/or other openings. Second opening 721*b* may be located at the center of the top and bottom of the cylinder of first shielded hinge 721. Second opening 721*b* can receive a fastener configured to fasten first shielded hinge 721 with first hinge 521. The fastener configured to fasten first shielded hinge 721 with first hinge 521 may be fastener 731 and/or other fasteners. First opening 721*a* may communicate through the side surface of the cylinder of first shielded hinge 721 to a surface inside the cylinder of first shielded hinge 721 created by second opening 721*b*.

In some implementations, the cylinder shape of the solid body of first shielded hinge 721 may include a cylindrical cavity on the top of the cylinder. The cylindrical cavity may be at least 25% of the length of the cylinder shape of first shielded hinge 721.

Second shielded hinge 722 may be in a shape of a cylinder and/or other shapes. Second shielded hinge 722 may be in a shape of a hollow cylinder and/or other shapes. Second shielded hinge 722 may be a solid body with the cylinder shape and/or other shapes. Second shielded hinge 722 may include a first opening 722*a*, a second opening 722*b* (depicted in FIG. 10), and/or other openings. Second opening 722*b* may communicate through the top to the bottom of the cylinder of second shielded hinge 722. Second opening 722*b* may be a circular opening and/or other openings. Second opening 722*b* may be located at the center of the top and bottom of the cylinder of second shielded hinge 722. Second opening 722*b* can receive a fastener configured to fasten second shielded hinge 722 with second hinge 522. The fastener configured to fasten second shielded hinge 722 with second hinge 522 may be fastener 732 and/or other fasteners. First opening 722*a* may communicate through the side surface of the cylinder of second shielded hinge 722 to a surface inside the cylinder of second shielded hinge 722 created by second opening 722*b*.

In some implementations, the cylinder shape of the solid body of second shielded hinge 722 may include a cylindrical cavity on the top of the cylinder. The cylindrical cavity may be at least 25% of the length of the cylinder shape of second shielded hinge 722.

First lock adaptor 711 may include one or more surfaces, one or more edges, one or more openings, and/or other components. The one or more surfaces of first lock adaptor 711 may include a first lock adaptor first surface, a first lock adaptor second surface, and/or other surfaces. The first lock adaptor first surface may be an extension of first surface 701*a*. The first lock adaptor second surface may be an extension of second surface 701*b*. The one or more edges of first lock adaptor 711 may include a first lock adaptor first edge 731*a*, a first lock adaptor second edge 731*b*, a first lock adaptor third edge 731*c*, a first lock adaptor fourth edge 731*d*, and/or other edges. The one or more openings of first lock adaptor 711 may include a first opening 751 and/or other openings. First lock adaptor 711 may be joined with or coupled to rotatable anti-intrusion lid 700 along second edge 702*b*. First lock adaptor 711 may be coupled to rotatable anti-intrusion lid 700 along a first portion of second edge 702*b*. The first portion of second edge 702*b* may be closer to third edge 702*c*. The first portion of second edge 702*b* may be aligned to opening 812 when rotatable anti-intrusion lid 700 may be closed.

First opening 751 may communicate through first lock adaptor 711 from the first lock adaptor first surface to the first lock adaptor second surface. First opening 751 may be located within the boundaries and/or perimeter of first lock adaptor 711. First opening 751 may be one or more of one or more cutaways, one or more apertures, and/or other openings.

In some implementations, first lock adaptor 711 may be defined by one or more of a length 763, a width 764, thickness 703*a*, and/or other measurements. In some implementations, length 763 may be in the range of 25 mm to 75 mm. In some implementations, length 763 may be in the range of 30 to 70 mm. In some implementations, length 763 may be in the range of 35 to 65 mm. In some implementations, length 763 may be in the range of 40 to 60 mm. In some implementations, length 763 may be 50 mm and/or other measurements. In some implementations, width 764 may be in the range of 10 to 30 mm. In some implementations, width 764 may be in the range of 15 to 25 mm. In some implementations, width 764 may be in the range of 20 to 22 mm. In some implementations, width 764 may be 21.3 mm and/or other measurements.

Second lock adaptor 712 may include one or more surfaces, one or more edges, one or more openings, and/or other components. The one or more surfaces of second lock adaptor 712 may include a second lock adaptor first surface, a second lock adaptor second surface, and/or other surfaces. The second lock adaptor first surface may be an extension of first surface 701*a*. The second lock adaptor second surface may be an extension of second surface 701*b*. The one or more edges of second lock adaptor 712 may include a second lock adaptor first edge 732*a*, a second lock adaptor second edge 732*b*, a second lock adaptor third edge 732*c*, a second lock adaptor fourth edge 732*d*, and/or other edges. The one or more openings of second lock adaptor 712 may include a second opening 752 and/or other openings. Second lock adaptor 712 may be joined with or coupled to rotatable anti-intrusion lid 700 along second edge 702*b*.

Second lock adaptor 712 may be coupled to rotatable anti-intrusion lid 700 along a second portion of second edge 702*b*. The second portion of second edge 702*b* may be closer to fourth edge 702*d*. The second portion of second edge 702*b* may be aligned to opening 811 when rotatable anti-intrusion lid 700 may be closed. The second portion of second edge 702*b* may be on the opposite side of first portion of second edge 702*b*.

Second opening 752 may communicate through second lock adaptor 712 from the second lock adaptor first surface to the second lock adaptor second surface. Second opening 752 may be located within the boundaries and/or perimeter of second lock adaptor 712. Second opening 752 may be one or more of one or more cutaways, one or more apertures, and/or other openings. In some implementations, second lock adaptor 712 may be defined by one or more of length 763, width 764, thickness 703*a*, and/or other measurements.

In some implementations, the one or more lock adaptors may be complementary locking mechanisms of rotatable anti-intrusion lid 700. In some implementations, the one or more lock adaptors may be referred to as complementary locking mechanisms. In some implementations, rotatable anti-intrusion lid 700 may be in the closed position and causing the one or more lock adaptors to engage with locking mechanism 800. The closed position of rotatable anti-intrusion lid 700 restricts removal of an equipment (such as equipment 900 illustrated in FIG. 18) from base container 100.

The one or more cutaways of rotatable anti-intrusion lid 700 may include a first cutaway, a second cutaway, a third cutaway, and/or other cutaways. The first cutaway, second cutaway, and/or other cutaways may be a cutaway of a slit along first edge 702*a*. The first cutaway, second cutaway, and/or other cutaways may be a cutaway of a rectangular slit along first edge 702*a*. The first cutaway may be positioned by first shielded hinge 721. The first cutaway may be positioned by first shielded hinge 721 near opening 721*a*. The first cutaway may be an opening for receiving first hinge 521. The first cutaway may be an opening for receiving first hinge 521 when rotatable anti-intrusion lid 700 is in a closed position. The second cutaway may be positioned by second shielded hinge 722. The second cutaway may be positioned by second shielded hinge 722 near opening 722*a*. The second cutaway may be an opening for receiving second hinge 522. The first cutaway may be an opening for receiving second hinge 522 when rotatable anti-intrusion lid 700 is in a closed position. The third cutaway and/or other cutaways may be a cutaway along second edge 702*b*. The third cutaway and/or other cutaways may be a rectangular cutaway along second edge 702*b*. The third cutaway may be in between first lock adaptor 711 and second lock adaptor 712. The third cutaway may enable portions of locking mechanism 800 to extend out of rotatable anti-intrusion lid 700. The third cutaway may enable lock housing 821 of locking mechanism 800 to extend out of rotatable anti-intrusion lid 700. The third cutaway may prevent the lock housing 821 of locking mechanism 800 from contacting second edge 702*b*. The third cutaway may prevent the lock housing 821 of locking mechanism 800 from blocking rotatable anti-intrusion lid 700 from closing.

Locking mechanism 800 may include one or more of an outer shell housing 830, one or more internal locking mechanisms, one or more handles, one or more rotation limiter bolts, one or more rotational restriction locks, one or more rotational restriction lock attachments, one or more lock housings, and/or other components. The one or more of the internal locking mechanism includes internal locking mechanism 840 (depicted in FIG. 14) and/or other internal locking mechanisms. The one or more handles may include handle 802 and/or other handles. Handle 802 may be coupled to locking mechanism 840. Handle 802 may be configured to rotate locking mechanism 840. The one or more rotation limiter bolts may include rotation limiter bolt 831 and/or other rotation limiter bolts. The one or more rotational restriction locks include rotational restriction lock 820 and/or other locks. The one or more rotational restriction lock attachments may include rotational restriction lock attachments 822 and/or other restriction lock attachments. The one or more lock housings include lock housing 821 and/or other lock housings.

Outer shell housing 830 may be in a shape of a cylinder and/or other shapes. Outer shell housing 830 may be a solid body with the cylinder shape and/or other shapes. Outer shell housing 830 may be in a shape of a hollow cylinder and/or other shapes with a closed end. Outer shell housing 830 may be in the shape of the hollow cylinder with closed end 803*a*. Outer shell housing 830 may include one or more surfaces, one or more openings, and/or other components. The one or more surfaces of outer shell housing 830 may include a first surface 801*a*, a second surface 801*b* (opposite to first surface 801*a* and not depicted), and/or other surfaces. The one or more openings of outer shell housing 830 may include a first opening 811, a second opening 812, a third opening 813, a fourth opening 814, a fifth opening 815, and/or other openings. In some implementations, outer shell housing 830 may be a solid body with the cylinder shape with a cavity on the top of the cylinder. The opening 815 may be the opening to the cavity.

First opening 811, second opening 812, third opening 813, fourth opening 814, fifth opening 815, and/or other openings of outer shell housing 830 communicate through the solid body of outer shell housing 830 from first surface 801*a* to second surface 801*b*. The individual openings may be one or more of one or more cutaways, one or more apertures, and/or other openings. First opening 811, second opening 812, third opening 813, and/or other openings may be in the shape of a rectangle. Third opening 813 may be positioned in between first opening 811 and second opening 812. Fourth opening 814 may be positioned in the opposite end of first opening 811. Fifth opening 815 may be positioned opposite to closed end 803*a*.

First opening 811 and second opening 812 may be sized to receive the first lock adaptors. First opening 811 may be sized to receive first lock adaptor 712. Second opening 812 may be sized to receive second lock adaptor 711. Third opening 813 may be sized to receive components of a standard lock. Fourth opening 814 may be sized to receive rotation limiter bolt 831. In some implementations, fourth opening 814 may be referred to as a rotation limiter bolt receptacle. Fifth opening 815 may be sized to receive internal locking mechanism 840.

In some implementations, locking mechanism 800 may be defined by one or more of a length 851, a diameter 852, and/or other measurements. In some implementations, length 851 may be in the range of 200 to 300 mm. In some implementations, length 851 may be in the range of 220 to 280 mm. In some implementations, length 851 may be in the range of 220 to 260 mm. In some implementations, length 851 may be in the range of 240 to 250 mm. In some implementations, length 851 may be 245.5 mm and/or other measurements. In some implementations, diameter 852 may be in the range of 20 to 60 mm. In some implementations, diameter 852 may be in the range of 30 to 50 mm. In some implementations, diameter 852 may be in the range of 30 to 40 mm. In some implementations, diameter 852 may be in the range of 35 to 40 mm. In some implementations, diameter 852 may be 38.1 mm and/or other measurements.

The individual sidewalls of the set of sidewalls may be positioned along the edges of bottom wall 200. The individual sidewalls of the set of sidewalls may be positioned perpendicular to bottom wall 200. First sidewall 300 may be parallel to second sidewall 400. First sidewall 300 and second sidewall 400 may be positioned on opposition edges of bottom wall 200. Third sidewall 500 may be parallel to fourth sidewall 600. Third sidewall 500 and fourth sidewall 600 may be positioned on opposition edges of bottom wall 200. When in the closed position (see FIG. 7), rotatable anti-intrusion lid 700 may be parallel to bottom wall 200. When in the opened position (see FIG. 1), rotatable anti-intrusion lid 700 parallel to fourth sidewall 600, and/or the surfaces of rotatable anti-intrusion lid 700 and third sidewall 500 may be on the same plane.

The individual sidewalls of the set of sidewalls may be coupled to bottom wall 200 by one or more welds, hinges, and/or other components. When the individual sidewalls of the set of sidewalls are coupled to bottom wall 200 with hinges, the individual sidewalls of the set of sidewalls may relate about the hinges. The individual sidewalls of the set of sidewalls and bottom wall 200 may be folded into a box-like structure (see FIG. 1) with the hinges or unfolded (see FIG. 9).

An edge of first sidewall 300 may be coupled with first edge 202*a* of bottom wall 200. The edges of first sidewall portion 321 and second sidewall portion 322 of first sidewall 300 may be coupled with first edge 202*a* of bottom wall 200. First portion first edge 302*a* and second portion first edge 304*a* may be coupled with first edge 202*a* of bottom wall 200.

First sidewall portion 321 may be coupled to bottom wall 200 along a portion of first edge 202*a* closest to third edge 202*c*. First sidewall portion 321 may be coupled to bottom wall 200 along a first end of first edge 202*a*. The first end of first edge 202*a* may be closest to third edge 202*c*. Second sidewall portion 322 may be coupled to bottom wall 200 along a portion of first edge 202*a* closest to fourth edge 202*d*. Second sidewall portion 322 may be coupled to bottom wall 200 along a second end of first edge 202*a*. The second end of first edge 202*a* may be closest to fourth edge 202*d*. The second end of first edge 202*a* may be opposite to the first end of first edge 202*a*.

An edge of second sidewall 400 may be coupled with second edge 202*b* of bottom wall 200. The edges of third sidewall portion 421 and fourth sidewall portion 422 of second sidewall 400 may be coupled with second edge 202*b* of bottom wall 200. Third portion first edge 402*a* and fourth portion first edge 404*a* may be coupled with second edge 202*b* of bottom wall 200.

Third sidewall portion 421 may be coupled to bottom wall 200 along a portion of second edge 202*b* closest to third edge 202*c*. Third sidewall portion 421 may be coupled to bottom wall 200 along a first end of second edge 202*b*. The first end of second edge 202*b* may be closest to third edge 202*c*. Fourth sidewall portion 422 may be coupled to bottom wall 200 along a portion of second edge 202*b* closest to fourth edge 202*d*. Fourth sidewall portion 422 may be coupled to bottom wall 200 along a second end of second edge 202*b*. The second end of second edge 202*b* may be closest to fourth edge 202*d*. The second end of second edge 202*b* may be opposite to the first end of second edge 202*b*.

An edge of third sidewall 500 may be coupled with third edge 202*c* of bottom wall 200. First edge 502*a* of third sidewall 500 may be coupled with third edge 202*c* of bottom wall 200. In some implementations, an edge of third sidewall 500 may be coupled with first sidewall portion 321. Third edge 502*c* of third sidewall 500 may be coupled to third edge 302*c* of first sidewall portion 321. In some implementations, an edge of third sidewall 500 may be coupled with third sidewall portion 421. Fourth edge 502*d* of third sidewall 500 may be coupled to third edge 402*c* of third sidewall portion 421.

An edge of fourth sidewall 600 may be coupled with fourth edge 202*d* of bottom wall 200. First edge 602*a* of fourth sidewall 600 may be coupled with fourth edge 202*d* of bottom wall 200. In some implementations, an edge of fourth sidewall 600 may be coupled with second sidewall portion 322. Third edge 602*c* (depicted in FIG. 9) of fourth sidewall 600 may be coupled to fourth edge 304*d* (depicted in FIG. 9) of second sidewall portion 322. In some implementations, an edge of fourth sidewall 600 may be coupled with fourth sidewall portion 422. Fourth edge 602*d* (depicted in FIG. 9) of fourth sidewall 600 may be coupled to fourth edge 402*d* (depicted in FIG. 9) of fourth sidewall portion 422.

The one or more anti-intrusion lips of first sidewall 300 and/or second sidewall 400 including first anti-intrusion lip 341, second anti-intrusion lip 342, third anti-intrusion lip 441, and/or fourth anti-intrusion lip 442, may be coupled to the one or more sidewalls and/or sidewall portion, including first sidewall portion 321, second sidewall portion 322, third sidewall portion 421, and/or fourth sidewall portion 422. The one or more anti-intrusion lips may be coupled to the one or more sidewalls and/or sidewall portion by one or more welds, fasteners, coupling, and/or other methods of joining the one or more anti-intrusion lips with the one or more sidewalls and/or sidewall portion. In some implementations, the one or more anti-intrusion lips may be folded portions of the one or more sidewalls and/or sidewall portion. In some implementations, one or more anti-intrusion lips may be coupled to the one or more sidewalls and/or sidewall portion to form a corner. In some implementations, the corner may include an edge. In some implementations, the corner may be chamfered and/or filleted.

First anti-intrusion lip 341 may be coupled to first sidewall 300. First anti-intrusion lip 341 may be coupled to first sidewall portion 321. First anti-intrusion lip 341 may be perpendicular to first sidewall portion 321. An edge of first anti-intrusion lip 341 may be coupled with third edge 302*c* of first sidewall portion 321. First anti-intrusion lip fourth edge 310*d* (depicted in FIG. 2) may be coupled with third edge 302*c* of first sidewall portion 321. First anti-intrusion lip 341 may be coupled to first sidewall portion 321 to form a corner. The corner formed by first anti-intrusion lip 341 and first sidewall portion 321 may be 90-degrees and/or close to 90-degrees. First anti-intrusion lip fourth edge 310*d* may be coupled with third edge 302*c* of first sidewall portion 321 such that first anti-intrusion lip second surface 309*b* (opposite to first anti-intrusion lip first surface 309*a* and not depicted) is 90-degrees from first portion second surface 301*b*. First anti-intrusion lip fourth edge 310*d* may be coupled with third edge 302*c* of first sidewall portion 321 such that first anti-intrusion lip second surface 309*b* is facing the inside of base container 100. First anti-intrusion lip fourth edge 310*d* may be coupled with third edge 302*c* of first sidewall portion 321 such that first anti-intrusion lip first surface 309*a* is facing the outside of base container 100. In some implementations, first anti-intrusion lip 341 may be coupled to third sidewall 500. First anti-intrusion lip second surface 309*b* may be coupled to first surface 501*a* of third sidewall 500.

Second anti-intrusion lip 342 may be coupled to first sidewall 300. Second anti-intrusion lip 342 may be coupled to second sidewall portion 322. Second anti-intrusion lip 342 may be perpendicular to second sidewall portion 322. An edge of second anti-intrusion lip 342 may be coupled with fourth edge 304*d* of second sidewall portion 322. Second anti-intrusion lip third edge 308*c* may be coupled with fourth edge 304*d* of second sidewall portion 322. Second anti-intrusion lip 342 may be coupled to second sidewall portion 322 to form a corner. The corner formed by second anti-intrusion lip 342 and second sidewall portion 322 may be 90-degrees and/or close to 90-degrees. Second anti-intrusion lip third edge 308*c* may be coupled with fourth edge 304*d* of second sidewall portion 322 such that second anti-intrusion lip second surface 307*b* (opposite of second anti-intrusion lip first surface 307*a* and not depicted) is 90-degrees from second portion second surface 303*b*. Second anti-intrusion lip third edge 308*c* may be coupled with fourth edge 304*d* of second sidewall portion 322 such that second anti-intrusion lip second surface 307*b* is facing the inside of base container 100. Second anti-intrusion lip third edge 308*c* may be coupled with fourth edge 304*d* of second sidewall portion 322 such that second anti-intrusion lip first surface 307*a* is facing the outside of base container 100. In some implementations, second anti-intrusion lip 342 may be coupled to fourth sidewall 600. Second anti-intrusion lip second surface 307*b* may be coupled to first surface 601*a* of fourth sidewall 600.

Third anti-intrusion lip 441 may be coupled to second sidewall 400. Third anti-intrusion lip 441 may be coupled to third sidewall portion 421. Third anti-intrusion lip 441 may be perpendicular to third sidewall portion 421. An edge of third anti-intrusion lip 441 may be coupled with third edge 402*c* of third sidewall portion 421. Third anti-intrusion lip third edge 410*c* may be coupled with third edge 402*c* of third sidewall portion 421. Third anti-intrusion lip 441 may be coupled to third sidewall portion 421 to form a corner. The corner formed by third anti-intrusion lip 441 and third sidewall portion 421 may be 90-degrees and/or close to 90-degrees. Third anti-intrusion lip third edge 410*c* may be coupled with third edge 402*c* of third sidewall portion 421 such third anti-intrusion lip second surface 409*b* is 90-degrees from third portion second surface 401*b*. Third anti-intrusion lip third edge 410*c* may be coupled with third edge 402*c* of third sidewall portion 421 such that third anti-intrusion lip second surface 409*b* is facing the inside of base container 100. Third anti-intrusion lip third edge 410*c* may be coupled with third edge 402*c* of third sidewall portion 421 such that third anti-intrusion lip first surface 409*a* is facing the outside of base container 100. In some implementations, third anti-intrusion lip 441 may be coupled to third sidewall 500. Third anti-intrusion lip second surface 409*b* may be coupled to first surface 501*a* of third sidewall 500.

Fourth anti-intrusion lip 442 may be coupled to second sidewall 400. Fourth anti-intrusion lip 442 may be coupled to fourth sidewall portion 422. Fourth anti-intrusion lip 442 may be perpendicular to fourth sidewall portion 422. An edge of fourth anti-intrusion lip 442 may be coupled with fourth edge 404*d* of fourth sidewall portion 422. Fourth anti-intrusion lip fourth edge 408*d* may be coupled with fourth edge 404*d* of fourth sidewall portion 422. Fourth anti-intrusion lip 442 may be coupled to fourth sidewall portion 422 to form a corner. The corner formed by fourth anti-intrusion lip 442 and fourth sidewall portion 422 may be 90-degrees and/or close to 90-degrees. Fourth anti-intrusion lip fourth edge 408*d* may be coupled with fourth edge 404*d* of fourth sidewall portion 422 such that fourth anti-intrusion lip second surface 407*b* is 90-degrees from fourth portion second surface 403*b*. Fourth anti-intrusion lip fourth edge 408*d* may be coupled with fourth edge 404*d* of fourth sidewall portion 422 such that fourth anti-intrusion lip second surface 407*b* is facing the inside of base container 100. Fourth anti-intrusion lip fourth edge 408*d* may be coupled with fourth edge 404*d* of fourth sidewall portion 422 such that fourth anti-intrusion lip first surface 407*a* is facing the outside of base container 100. In some implementations, fourth anti-intrusion lip 442 may be coupled to fourth sidewall 600. Fourth anti-intrusion lip second surface 407*b* may be coupled to first surface 601*a* of fourth sidewall 600.

The one or more anti-intrusion lips may partially enclose portions of third sidewall 500 and/or fourth sidewall 600. In some implementations, first anti-intrusion lip 341 and third anti-intrusion lip 441 may partially enclose portions of third sidewall 500. First anti-intrusion lip first surface 309*a* of first anti-intrusion lip 341 and third anti-intrusion lip first surface 409*a* of third anti-intrusion lip 441 may partially enclose portions of third sidewall 500. First anti-intrusion lip second surface 309*b* (opposite of first anti-intrusion lip first surface 309*a* and not depicted) of first anti-intrusion lip 341 and/or third anti-intrusion lip second surface 409*b* (third anti-intrusion lip first surface 409*a*) may be facing first surface 501*a* of third sidewall 500. In some implementations, first anti-intrusion lip 341 and third anti-intrusion lip 441 may partially enclose portions of third sidewall 500 such that movement of third sidewall 500 in one or more directions may be restricted. In some implementations, first anti-intrusion lip 341 and third anti-intrusion lip 441 may partially enclose portions of third sidewall 500 such that access to base container 100 from third sidewall 500 may be restricted.

In some implementations, first anti-intrusion lip 341 and third anti-intrusion lip 441 may partially enclose portions of third sidewall 500 such that the sidewalls (such as first sidewall 300, second sidewall 400, and third sidewall 500) cannot be tampered with. For example, the first anti-intrusion lip 341 and third anti-intrusion lip 441 may partially enclose portions of third sidewall 500 such that a person cannot pry open base container 100 from the edges (such as third edge 502*c* and/or fourth edge 502*d*) of third sidewall 500 or sidewalls adjacent to third sidewall 500 (such as third edge 302*c* and/or third edge 402*c*).

In some implementations, second anti-intrusion lip 342 and fourth anti-intrusion lip 422 may partially enclose portions of fourth sidewall 600. Second anti-intrusion lip first surface 307*a* of second anti-intrusion lip 342 and fourth anti-intrusion lip first surface 407*a* of fourth anti-intrusion lip 422 may partially enclose portions of fourth sidewall 600. Second anti-intrusion lip second surface 307*b* of second anti-intrusion lip 342 and/or fourth anti-intrusion lip second surface 407*b* may be facing first surface 601*a* of fourth sidewall 600. In some implementations, second anti-intrusion lip 342 and fourth anti-intrusion lip 422 may partially enclose portions of fourth sidewall 600 such that movement of fourth sidewall 600 in one or more directions may be restricted. In some implementations, second anti-intrusion lip 342 and fourth anti-intrusion lip 422 may partially enclose portions of fourth sidewall 600 such that access to base container 100 from fourth sidewall 600 may be restricted.

In some implementations, second anti-intrusion lip 342 and fourth anti-intrusion lip 422 may partially enclose portions of fourth sidewall 600 such that the sidewalls (such as first sidewall 300, second sidewall 400, and fourth sidewall 600) cannot be tampered with. For example, the second anti-intrusion lip 342 and fourth anti-intrusion lip 422 may partially enclose portions of fourth sidewall 600 such that a person cannot pry open base container 100 from the edges (such as third edge 602*c* and/or fourth edge 602*d*) of third sidewall 500 or sidewalls adjacent to fourth sidewall 600 (such as third edge 304*c* and/or third edge 404*d*).

In some implementations, the surface of third sidewall 500 may be perpendicular to the surface of first sidewall 300 and second sidewall 400. For example, second surface 501*b* of third sidewall 500 may be perpendicular to the surface of first sidewall 300 and second sidewall 400 (such as first portion second surface 301*b* and third portion second surface 401*b*). The surfaces of first anti-intrusion lip 341 and third anti-intrusion lip 441 may be parallel to the surface of third sidewall 500. For example, the first anti-intrusion lip second surface 309*b* and third anti-intrusion lip second surface 409*b* may be parallel to first surface 501*a* of third sidewall 500.

In some implementations, the surface of fourth sidewall 600 may be perpendicular to the surface of first sidewall 300 and second sidewall 400. For example, second surface 601*b* of fourth sidewall 600 may be perpendicular to the surface of first sidewall 300 and second sidewall 400 (such as second portion second surface 303*b* and fourth portion second surface 403*b*). The surfaces of second anti-intrusion lip 342 and fourth anti-intrusion lip 442 may be parallel to the surface of fourth sidewall 600. For example, the second anti-intrusion lip second surface 307*b* and fourth anti-intrusion lip second surface 407*b* may be parallel to first surface 601*a* of fourth sidewall 600.

The one or more anti-intrusion lips of rotatable anti-intrusion lid 700 including fifth anti-intrusion lip 741, sixth anti-intrusion lip 742, may be coupled to the rotatable anti-intrusion lid 700. The one or more anti-intrusion lips may be coupled to rotatable anti-intrusion lid 700 by one or more welds, fasteners, coupling, and/or other methods of joining the one or more anti-intrusion lips with rotatable anti-intrusion lid 700. In some implementations, the one or more anti-intrusion lips may be folded portions of rotatable anti-intrusion lid 700. In some implementations, one or more anti-intrusion lips may be coupled to rotatable anti-intrusion lid 700 to form a corner. In some implementations, the corner may include an edge. In some implementations, the corner may be chamfered and/or filleted.

Fifth anti-intrusion lip 741 may be coupled to rotatable anti-intrusion lid 700. Fifth anti-intrusion lip 741 may be perpendicular to rotatable anti-intrusion lid 700. An edge of fifth anti-intrusion lip 741 may be coupled with third edge 702*c* of rotatable anti-intrusion lid 700. Fifth anti-intrusion lip third edge 706*c* may be coupled with third edge 702*c* of rotatable anti-intrusion lid 700. Fifth anti-intrusion lip 741 may be coupled to rotatable anti-intrusion lid 700 to form a corner. The corner formed by fifth anti-intrusion lip 741 and rotatable anti-intrusion lid 700 may be 90-degrees and/or close to 90-degrees. Fifth anti-intrusion lip third edge 706*c* may be coupled with third edge 702*c* of rotatable anti-intrusion lid 700 such fifth anti-intrusion lip second surface 705*b* is 90-degrees from second surface 701*b*. Fifth anti-intrusion lip third edge 706*c* may be coupled with third edge 702*c* of rotatable anti-intrusion lid 700 such that fifth anti-intrusion lip second surface 705*b* is facing the inside of base container 100 when rotatable anti-intrusion lid 700 is in the closed position. Fifth anti-intrusion lip third edge 706*c* may be coupled with third edge 702*c* of rotatable anti-intrusion lid 700 such that fifth anti-intrusion lip first surface 705*a* is facing the outside of base container 100 when rotatable anti-intrusion lid 700 is in the closed position.

Sixth anti-intrusion lip 742 may be coupled to rotatable anti-intrusion lid 700. Sixth anti-intrusion lip 742 may be perpendicular to rotatable anti-intrusion lid 700. An edge of sixth anti-intrusion lip 742 may be coupled with fourth edge 702*d* of rotatable anti-intrusion lid 700. Sixth anti-intrusion lip third edge 708*c* may be coupled with fourth edge 702*d* of rotatable anti-intrusion lid 700. Sixth anti-intrusion lip 742 may be coupled to rotatable anti-intrusion lid 700 to form a corner. The corner formed by sixth anti-intrusion lip 742 and rotatable anti-intrusion lid 700 may be 90-degrees and/or close to 90-degrees. Sixth anti-intrusion lip third edge 708*c* may be coupled with fourth edge 702*d* of rotatable anti-intrusion lid 700 such that sixth anti-intrusion lip second surface 707*b* is 90-degrees from second surface 701*b*. Sixth anti-intrusion lip fourth edge 708*d* may be coupled with fourth edge 702*d* of rotatable anti-intrusion lid 700 such that sixth anti-intrusion lip second surface 707*b* is facing the inside of base container 100 when rotatable anti-intrusion lid 700 is in the closed position. Sixth anti-intrusion lip third edge 708*c* may be coupled with fourth edge 702*d* of rotatable anti-intrusion lid 700 such that sixth anti-intrusion lip second surface 707*b* is facing the outside of base container 100 when rotatable anti-intrusion lid 700 is in the closed position.

The one or more lock adaptors including first lock adaptor 711 and second lock adaptor 712, may be coupled to the rotatable anti-intrusion lid 700. The one or more lock adaptors may be coupled to rotatable anti-intrusion lid 700 by one or more welds, fasteners, coupling, and/or other methods of joining the one or more lock adaptors with rotatable anti-intrusion lid 700. In some implementations, the one or more lock adaptors may be folded portions of rotatable anti-intrusion lid 700. In some implementations, one or more lock adaptors may be coupled to rotatable anti-intrusion lid 700 to form a corner. In some implementations, the corner may include an edge. In some implementations, the corner may be chamfered and/or filleted.

First lock adaptor 711 may be coupled to rotatable anti-intrusion lid 700. First lock adaptor 711 may be perpendicular to rotatable anti-intrusion lid 700. An edge of first lock adaptor 711 may be coupled with second edge 702*b* of rotatable anti-intrusion lid 700. First lock adaptor second edge 731*b* may be coupled with second edge 702*b* of rotatable anti-intrusion lid 700. First lock adaptor 711 may be coupled to rotatable anti-intrusion lid 700 to form a corner. The corner formed by first lock adaptor 711 and rotatable anti-intrusion lid 700 may be 90-degrees and/or close to 90-degrees. First lock adaptor second edge 731*b* may be coupled with second edge 702*b* of rotatable anti-intrusion lid 700 such that first lock adaptor 711 may be inserted into second opening 812.

Second lock adaptor 712 may be coupled to rotatable anti-intrusion lid 700. Second lock adaptor 712 may be perpendicular to rotatable anti-intrusion lid 700. An edge of second lock adaptor 712 may be coupled with second edge 702*b* of rotatable anti-intrusion lid 700. Second lock adaptor second edge 732*b* may be coupled with second edge 702*b* of rotatable anti-intrusion lid 700. Second lock adaptor 712 may be coupled to rotatable anti-intrusion lid 700 to form a corner. The corner formed by second lock adaptor 712 and rotatable anti-intrusion lid 700 may be 90-degrees and/or close to 90-degrees. Second lock adaptor second edge 732*b* may be coupled with second edge 702*b* of rotatable anti-intrusion lid 700 such that second lock adaptor 712 may be inserted into first opening 811.

First shielded hinge 721 and second shielded hinge 722 may be coupled to the rotatable anti-intrusion lid 700. First shielded hinge 721 and second shielded hinge 722 may be coupled to rotatable anti-intrusion lid 700 by one or more welds, fasteners, coupling, and/or other methods of joining first shielded hinge 721 and second shielded hinge 722 with rotatable anti-intrusion lid 700. In some implementations, first shielded hinge 721 and second shielded hinge 722 may be folded portions of rotatable anti-intrusion lid 700. First shielded hinge 721 and second shielded hinge 722 may be folded portions of rotatable anti-intrusion lid 700 to form a cylinder shape.

First shielded hinge 721 may be coupled to rotatable anti-intrusion lid 700. The outer surface of the first shielded hinge 721 may be coupled to rotatable anti-intrusion lid 700. The outer surface of first shielded hinge 721 may be coupled to rotatable anti-intrusion lid 700 along the height of the cylinder-shaped first shielded hinge 721. First shielded hinge 721 may be coupled to rotatable anti-intrusion lid 700 such that first shielded hinge 721 may be coupled to first hinge 521.

First shielded hinge 721 may be coupled to rotatable anti-intrusion lid 700 along an edge of rotatable anti-intrusion lid 700. First shielded hinge 721 may be coupled to rotatable anti-intrusion lid 700 along first edge 702*a* of rotatable anti-intrusion lid 700. The side of first shielded hinge 721 may be coupled to rotatable anti-intrusion lid 700 along first edge 702*a* of rotatable anti-intrusion lid 700. The side of the cylinder-shaped first shielded hinge 721 may be coupled to rotatable anti-intrusion lid 700 along first edge 702*a* of rotatable anti-intrusion lid 700. First shielded hinge 721 may be coupled to rotatable anti-intrusion lid 700 along a portion of first edge 702*a* closest to third edge 702*c*. First shielded hinge 721 may be coupled to rotatable anti-intrusion lid 700 along a first end of first edge 702*a*. The first end of first edge 702*a* may be closest to third edge 702*c*.

Second shielded hinge 722 may be coupled to rotatable anti-intrusion lid 700. The outer surface of the second shielded hinge 722 may be coupled to rotatable anti-intrusion lid 700. The outer surface of second shielded hinge 722 may be coupled to rotatable anti-intrusion lid 700 along the height of the cylinder-shaped second shielded hinge 722. Second shielded hinge 722 may be coupled to rotatable anti-intrusion lid 700 such that second shielded hinge 722 may be coupled to second hinge 522.

Second shielded hinge 722 may be coupled to rotatable anti-intrusion lid 700 along an edge of rotatable anti-intrusion lid 700. Second shielded hinge 722 may be coupled to rotatable anti-intrusion lid 700 along the same edge as first shielded hinge 721. Second shielded hinge 722 may be coupled to rotatable anti-intrusion lid 700 along first edge 702*a* of rotatable anti-intrusion lid 700. The side of second shielded hinge 722 may be coupled to rotatable anti-intrusion lid 700 along first edge 702*a* of rotatable anti-intrusion lid 700. The side of the cylinder-shaped second shielded hinge 722 may be coupled to rotatable anti-intrusion lid 700 along first edge 702*a* of rotatable anti-intrusion lid 700. Second shielded hinge 722 may be coupled to rotatable anti-intrusion lid 700 along a portion of first edge 702*a* closest to fourth edge 702*d*. Second shielded hinge 722 may be coupled to rotatable anti-intrusion lid 700 along a second end of first edge 702*a*. The second end of first edge 702*a* may be closest to fourth edge 702*d*. The first end of first edge 702*a* may be opposite to the second end of first edge 702*a*.

Locking mechanism 800 may be coupled to fourth sidewall 600. Locking mechanism 800 may be coupled to fourth sidewall 600 such that locking mechanism 800 may be enabled to restrict the movement of rotatable anti-intrusion lid 700. Locking mechanism 800 may be coupled to fourth sidewall 600 such that rotatable anti-intrusion lid 700 may be coupled to locking mechanism 800 when rotatable anti-intrusion lid 700 is in the closed position. Locking mechanism 800 may be coupled to fourth sidewall 600 such the one or more lock adaptors may be inserted into the one or more openings of locking mechanism 800 when rotatable anti-intrusion lid 700 may be in the closed position. For example, locking mechanism 800 may be coupled to fourth sidewall 600 such the first lock adaptor 711 may be inserted in opening 812 and/or second lock adaptor 712 may be inserted in opening 811 when rotatable anti-intrusion lid 700 may be in the closed position.

Locking mechanism 800 may be coupled to fourth sidewall 600 by first lock attachment 620. Locking mechanism 800 may be coupled to first lock attachment 620. Locking mechanism 800 may be coupled to first lock attachment 620 by the one or more couplings. Outer shell housing 830 of locking mechanism 800 may be coupled to first lock attachment 620. Outer shell housing 830 may be coupled to first lock attachment 620 such that opening 811 and opening 812 may be configured to receive second lock adaptor 712 and first lock adaptor 711. Outer shell housing 830 may be coupled to first lock attachment 620 such that lock housing 821 may be positioned along the center of first lock attachment 620.

In some implementation, locking mechanism 800 may be configured to restrain and/or restrict the movement of the rotatable anti-intrusion lid 700 and/or other components of base container 100. Locking mechanism 800 may be configured to restrain and/or restrict the movement of rotatable anti-intrusion lid 700 when in a locked position. Locking mechanism 800 may release rotatable anti-intrusion lid 700 from being restrained or release the restriction in movement of rotatable anti-intrusion lid 700 when in an unlocked position. Rotatable anti-intrusion lid 700 and/or other components may obtain a locked position when the one or more internal locking mechanism is engaged. For example, rotatable anti-intrusion lid 700 and/or other components may obtain a locked position when internal locking mechanism 840 is engaged. Rotatable anti-intrusion lid 700 and/or other components may obtain an unlocked position when the one or more internal locking mechanism are disengaged. For example, rotatable anti-intrusion lid 700 and/or other components may obtain an unlocked position when internal locking mechanism 840 is disengaged.

In some implementations, internal locking mechanism 840 may fit within the outer shell housing 830. Internal locking mechanism 840 may have the similar shape as the outer shell housing 830. Internal locking mechanism 840 may move and/or rotate within the outer shell housing 830. Internal locking mechanism 840 may be rotated within the outer shell housing 830 by handle 802 and/or other mechanisms. Rotation limiter bolt 831 may be configured to limit the degree of rotation of internal locking mechanism 840 within the outer shell housing 830. In a non-limiting example, rotation limiter bolt 831 may be inserted into the outer shell housing 830 through opening 814 and/or other openings, internal locking mechanism 840, and/or other components. Rotation limiter bolt 831 may limit the degree of rotation of internal locking mechanism 840 within the outer shell housing 830 by catching internal locking mechanism 840 at a certain rotation angle.

In some implementations, internal locking mechanism 840 may include one or more latch mechanisms. The one or more latch mechanism may include one or more of a first latch, a second latch, and/or other latches. The one or more latch mechanism may latch onto the one or more lock adaptors. For example, the first latch may latch on to first lock adaptor 711, the second latch may latch on to second lock adaptor 712, and/or other latches may latch on to other lock adaptors. The one or more latch mechanism may include one or more hooks, teeth, and/or other structures to latch onto components of the locking mechanism 800. The one or more latch mechanism may be inserted into the one or more lock adaptors. For example, the first latch may be inserted into opening 751 to latch on to first lock adaptor 711, the second latch may be inserted into opening 752 to latch on to second lock adaptor 712, and/or other latches may be inserted into other openings of other lock adaptors to latch on to the lock adaptors.

In some implementations, a rotation of internal locking mechanism 840 within the outer shell housing 830 may engage the first latch, the second latch, and/or other latches. In a non-limiting example, referring to FIG. 14, a 90-degree first direction rotation of internal locking mechanism 840 to the position shown in FIG. 15 may cause the one or more latches to be inserted into the openings of the one or more lock adaptors. The one or more latches being inserted into the openings of the one or more lock adaptors may restrict the movement of the rotatable anti-intrusion lid 700 shown in FIG. 8. The 90-degree first direction rotation may be a clockwise direction and/or other directions.

Figure 14:
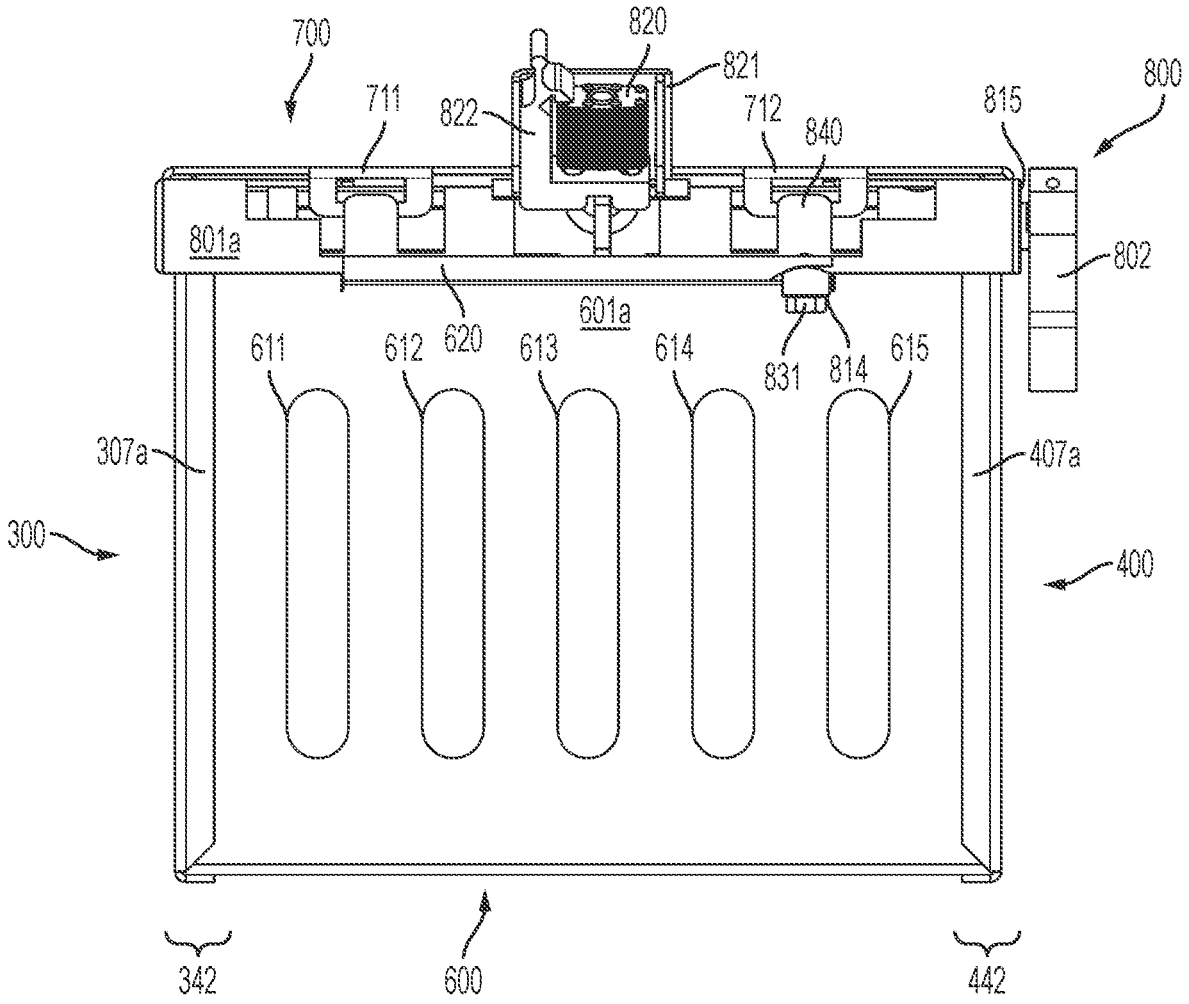
FIG. 14 is a three-dimensional diagram illustrating a cutaway view of the locking mechanism in an opened position on the equipment locking system, in accordance with one or more implementations.

A 90-degree second direction rotation of internal locking mechanism 840 to the position shown in FIG. 14 may cause the one or more latches to be uninserted from the openings of the one or more lock adaptors. The one or more latches being removed from the openings of the one or more lock adaptors may enable the movement of the rotatable anti-intrusion lid 700 shown in FIG. 1. The 90-degree first direction rotation may be in a counterclockwise direction and/or other directions.

In some implementations, rotational restriction lock 820 may be inserted into third opening 813 and removably coupled to a portion of internal locking mechanism 840. A third latch of internal locking mechanism 840 may be configured to latch onto the rotational restriction lock 820. For example, the third latch may be inserted into a shackle clearance of rotational restriction lock 820. A rotation of internal locking mechanism 840 may enable the third latch to latch onto rotational restriction lock 820 when rotational restriction lock 820 is inserted into third opening 813. In some implementations, third opening 813 may be referred to as a lock receptacle. Not shown in the figures, a 180-degree rotation of handle 802 from the position showed in FIG. 14 may allow rotational restriction lock 820 to be disengaged from the third latch. The rotational restriction lock 820 may be uncoupled from internal locking mechanism 840 when the third latch is disengaged.

Rotation limiter bolt 831 may be inserted in the outer shell housing 830 through fourth opening 814. Rotation limiter bolt 831 may be inserted into a portion of internal locking mechanism 840 to limit the rotational angle of internal locking mechanism 840. Rotation limiter bolt 831 may limit the rotational angle of internal locking mechanism 840 such that internal locking mechanism 840 may not be rotated to disengage the third latch from rotational restriction lock 820.

In some implementations, rotation limiter bolt 831 may limit the rotational angle of internal locking mechanism 840 between 0 to 90 degrees. In some implementations, rotation limiter bolt 831 may limit the rotational angle of internal locking mechanism 840 between 0 to 60 degrees. In some implementations, rotation limiter bolt 831 may limit the rotational angle of internal locking mechanism 840 between 0 to 30 degrees. In some implementations, rotation limiter bolt 831 may limit the rotational angle of internal locking mechanism 840 between 30 to 60 degrees. In some implementations, rotation limiter bolt 831 may limit the rotational angle of internal locking mechanism 840 between 50 to 60 degrees. In some implementations, the removal of rotation limiter bolt 831 from the outer shell housing 830 may allow internal locking mechanism 840 to rotate between 0 to 270 degrees. In some implementations, the removal of rotation limiter bolt 831 from the outer shell housing 830 may allow internal locking mechanism 840 to rotate between 0 to 180 degrees. In some implementations, the removal of rotation limiter bolt 831 from the outer shell housing 830 may allow internal locking mechanism 840 to rotate between 0 to 135 degrees.

Referring to FIG. 14, in some implementations, rotational restriction lock 820, rotational restriction lock attachment 822, and/or other components may be configured to restrict the movement of internal locking mechanism 840. Rotational restriction lock attachment 822 may be sized to enclose rotational restriction lock 820 on one or more sides. Rotational restriction lock attachment 822 may be sized to cup rotational restriction lock 820. Rotational restriction lock attachment 822 may be sized to cup rotational restriction lock 820 such that rotational restriction lock attachment 822 and rotational restriction lock 820 may be inserted into lock housing 821.

In some implementations, rotational restriction lock 820 may be a standard padlock. The standard padlock may have a locked position and/or an unlocked position. Rotational restriction lock 820 may restrict the rotation of internal locking mechanism 840 when in the locked position. Rotational restriction lock 820 may enable the rotation of internal locking mechanism 840 when in the unlocked position. When rotational restriction lock 820 is in the locked position rotational restriction lock 820 pushes against the rotational restriction lock attachment 822 against internal locking mechanism 840 (specifically the third latch). When rotational restriction lock 820 is in the unlocked position, rotational restriction lock 820 may not be pushed against the rotational restriction lock attachment 822 against internal locking mechanism 840 (specifically the third latch). Rotational restriction lock attachment 822 may be configured to push against internal locking mechanism 840 (specifically the third latch) to restrict rotation of internal locking mechanism 840. In some implementations, rotational restriction lock 820 may restrict the movement of internal locking mechanism 840 by latching onto internal locking mechanism 840 (specifically the third latch). For example, the shackles of rotational restriction lock 820 may pull against the third latch to restrict the movement of internal locking mechanism 840. There may be other systems and/or methods for internal locking mechanism 840 and/or rotational restriction lock attachment 822 to restrict the movement of internal locking mechanism 840.

In some implementation, rotational restriction lock attachment 822 comprise a solid body having one or more surfaces and/or one or more side edges. The solid body may form a shape, such as a substantially L-shaped block and/or other shapes. Rotational restriction lock attachment 822 may include one or more openings for the shackles of the rotational restriction lock 820. The one or more openings may include one or more of one or more cutaways, one or more apertures, and/or other openings. The one or more openings may have individual shapes. Rotational restriction lock attachment 822 may enclose a portion of or an entire rotational restriction lock 820 on one or more sides. The shackles of rotational restriction lock 820 may protrude out of the one or more openings of rotational restriction lock attachment 822. Rotational restriction lock attachment 822 may include a tooth for restricting the rotational restriction lock 820 from sliding or moving in one or more directions. The teeth may be located on the opposite end of the shackles.

In some implementations, outer lock housing 830 may be configured to enclose the rotational restriction lock 820, rotational restriction lock attachment 822, and/or other components on one or more sides. The outer lock housing 830 may sit above the third opening 813. The outer lock housing 830 and the outer shell housing 830 may form a unitary structure. The outer lock housing 830 may be configured such that the outer lock housing 830 may restrict access to the rotational restriction lock 820 and/or rotational restriction lock attachment 822 on one or more sides when the rotational restriction lock 820 and/or the rotational restriction lock 820 is inserted into outer lock housing 830.

Figure 3:
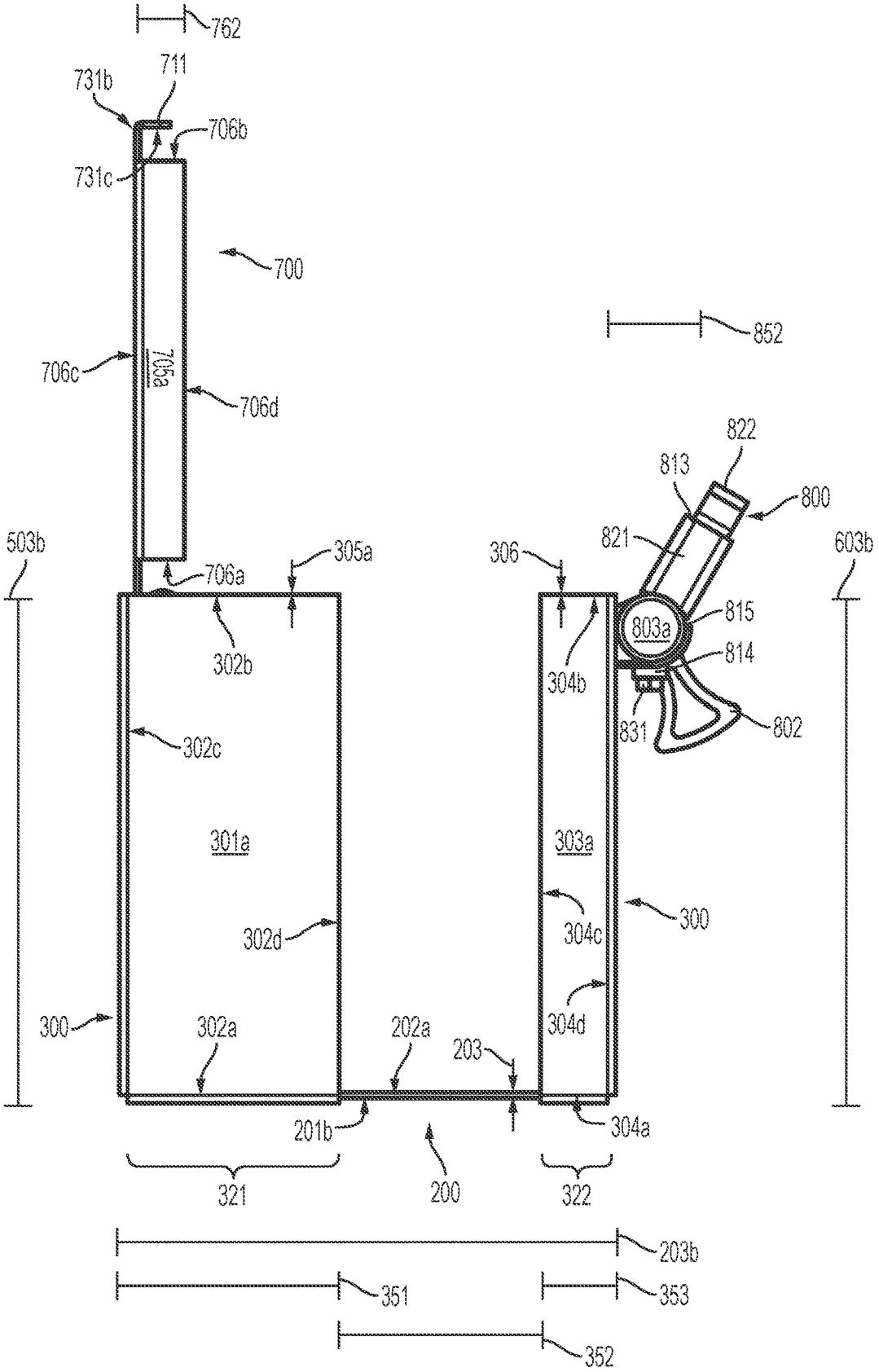
FIG. 3 is a three-dimensional diagram illustrating a first side view of the equipment locking system with the opened anti-intrusion lid, in accordance with one or more implementations.

As illustrated in FIG. 3, a first side view of base container 100 with an opened rotatable anti-intrusion lid 700. The first side view being a side with first sidewall 300.

Figure 4:
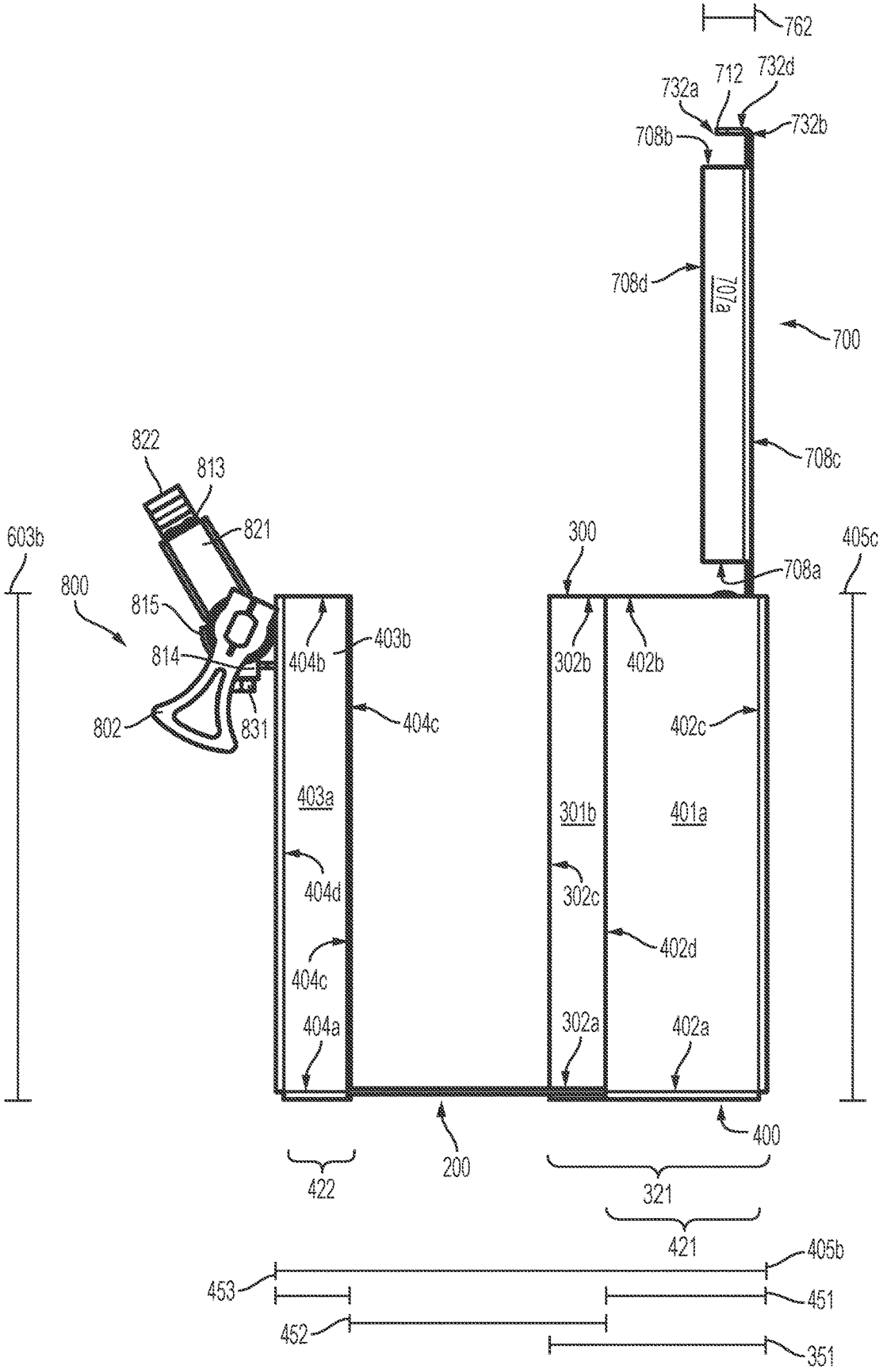
FIG. 4 is a three-dimensional diagram illustrating a second side view of the equipment locking system with the opened anti-intrusion lid, in accordance with one or more implementations.

As illustrated in FIG. 4, a second side view of base container 100 with the opened rotatable anti-intrusion lid 700. The second side view being a side with second sidewall 400.

As illustrated in FIG. 5, a back-side view of base container 100 with the opened rotatable anti-intrusion lid 700. The second side view being a side with third sidewall 500.

As illustrated in FIG. 6, a top-side view of base container 100 with the opened rotatable anti-intrusion lid 700. The second side view showing the first surface 201*a* of bottom wall 200.

Figure 7:
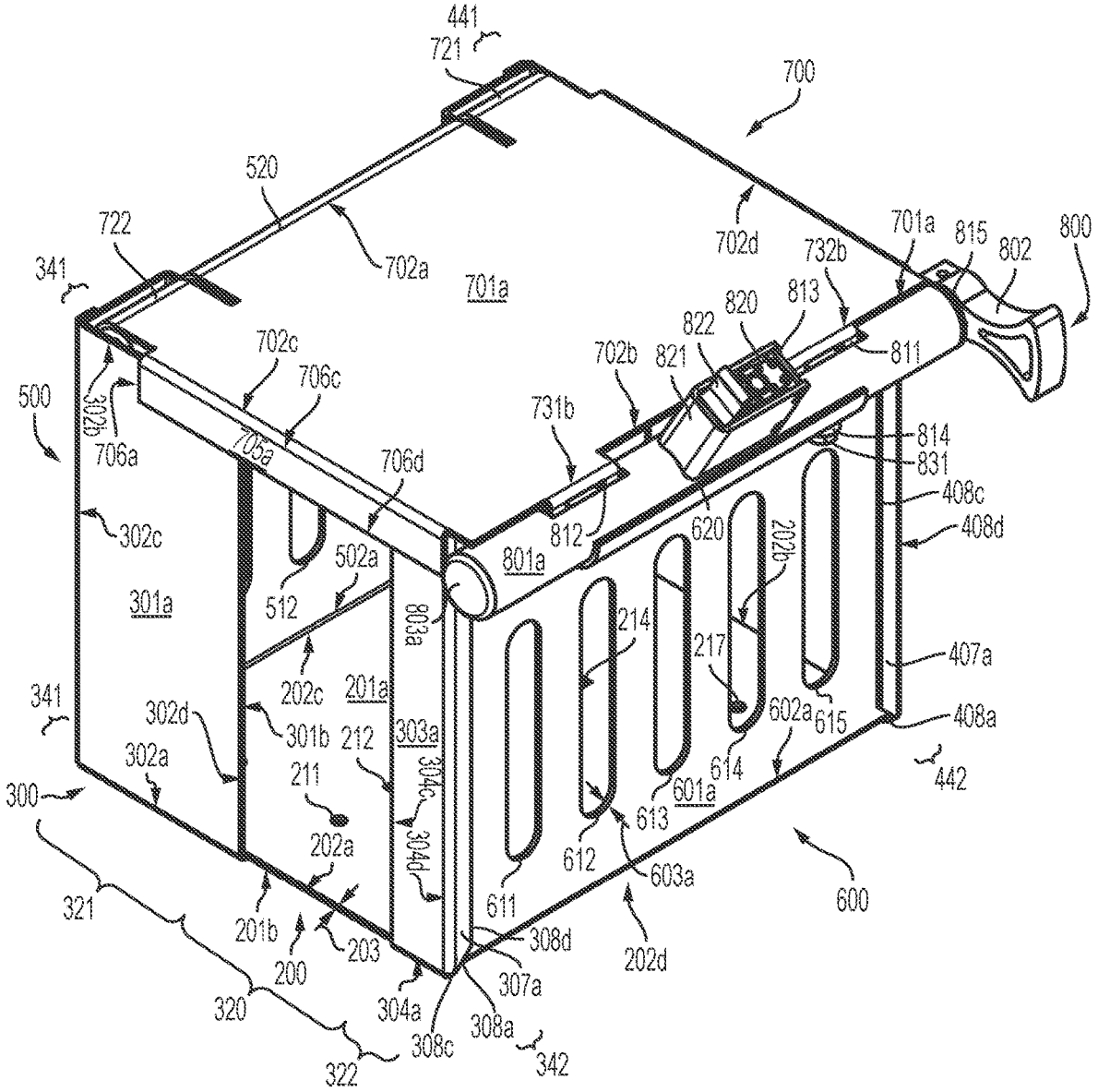
FIG. 7 is a three-dimensional diagram illustrating the first isometric view of the equipment locking system with a closed anti-intrusion lid, in accordance with one or more implementations.

As illustrated in FIG. 7, an isometric view of base container 100 a closed rotatable anti-intrusion lid 700 and locking mechanism 800 in the locked position.

Figure 8:
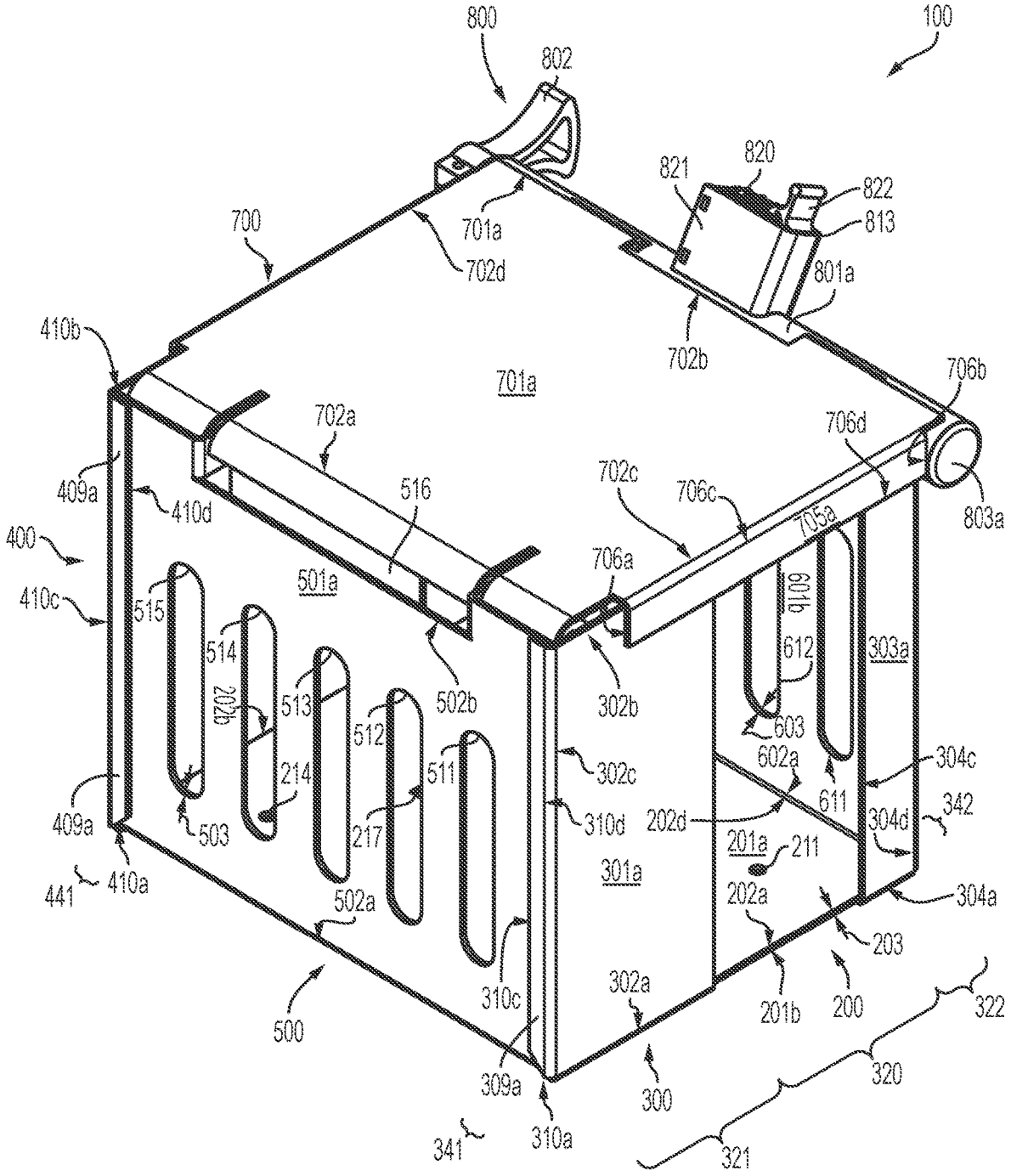
FIG. 8 is a three-dimensional diagram illustrating the second isometric view of the equipment locking system with the closed anti-intrusion lid, in accordance with one or more implementations.

As illustrated in FIG. 8, an isometric view of base container 100 a closed rotatable anti-intrusion lid 700 and locking mechanism 800 in the locked position.

Figure 9:
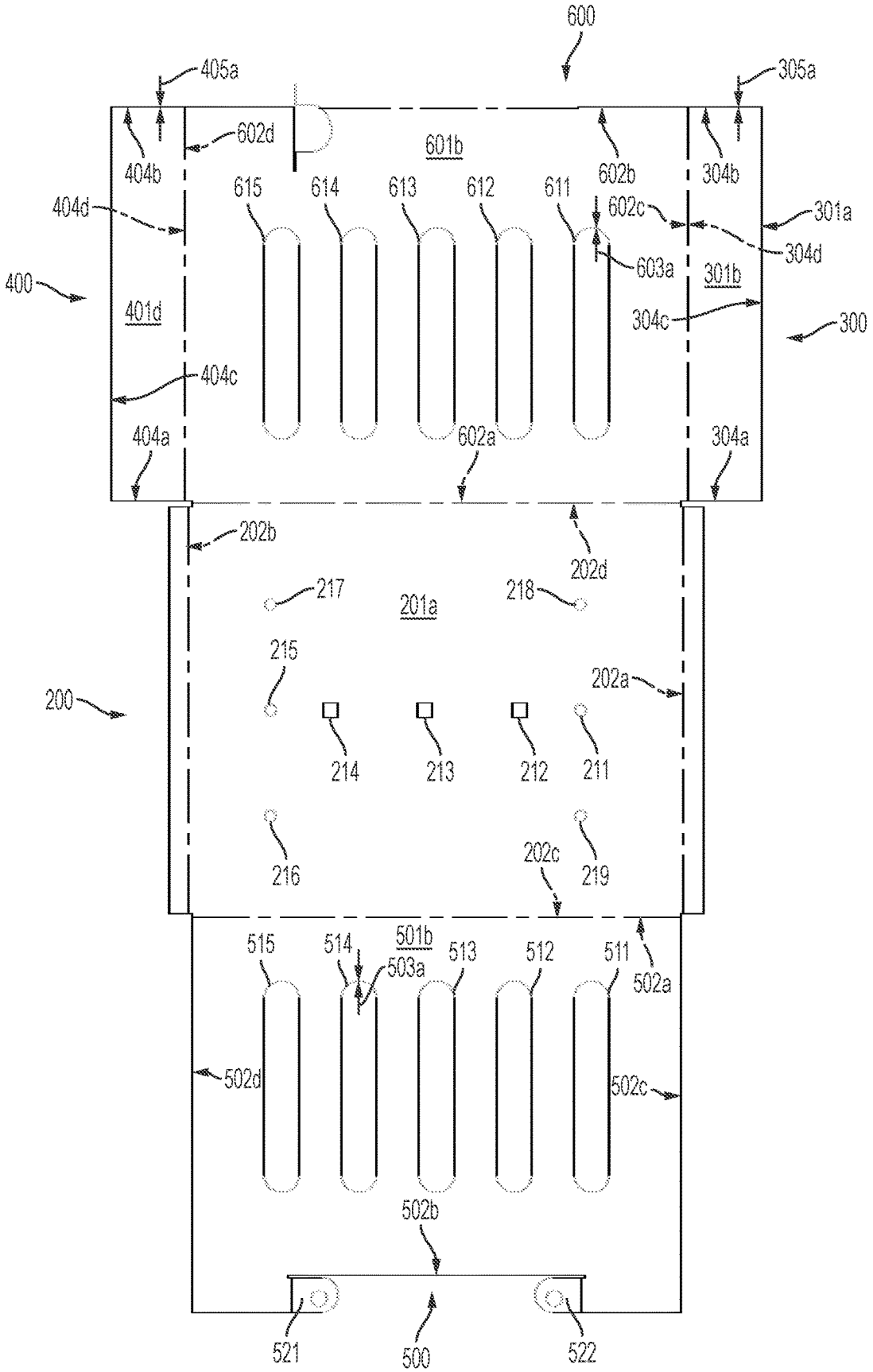
FIG. 9 is a two-dimensional diagram illustrating the top view of equipment locking system unfolded into a sheet, in accordance with one or more implementations.

As illustrated in FIG. 9, the top-side view of base container 100 without rotatable anti-intrusion lid 700 and the sidewalls unfolded.

Figure 10:
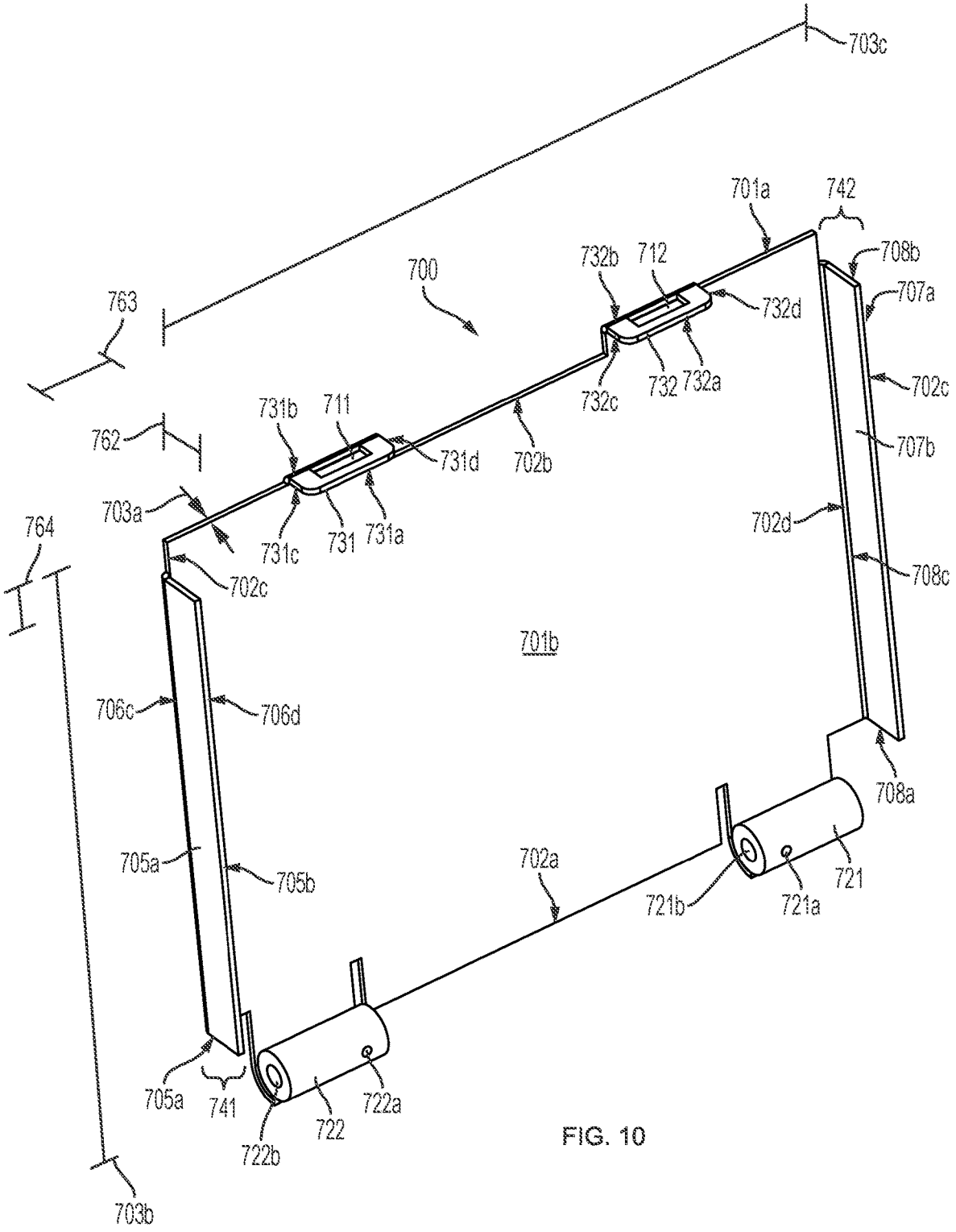
FIG. 10 is a three-dimensional diagram illustrating the anti-intrusion lid uncoupled from the equipment locking system, in accordance with one or more implementations.

As illustrated in FIG. 10, a view of rotatable anti-intrusion lid 700 uncoupled from base container 100.

Figure 11:
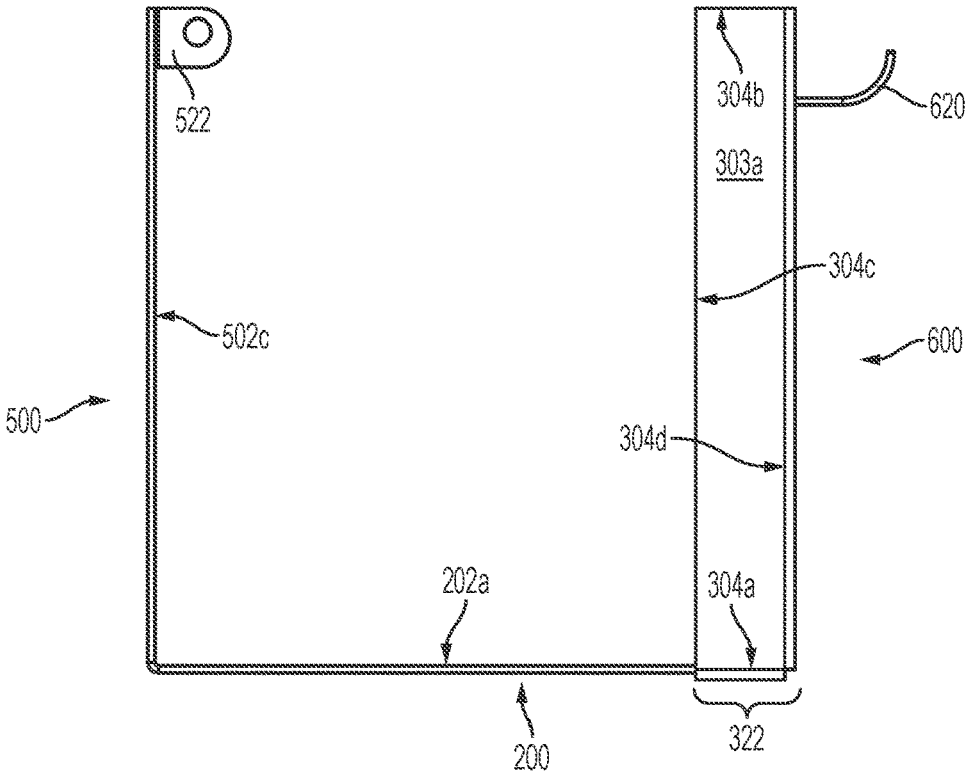
FIG. 11 is a three-dimensional diagram illustrating the first side view of equipment locking system without some components, in accordance with one or more implementations.

As illustrated in FIG. 11, the first side view of base container 100 without anti-intrusion lid 700, locking mechanism 800, and portions of first sidewall 300 and second sidewall 400.

Figure 12:
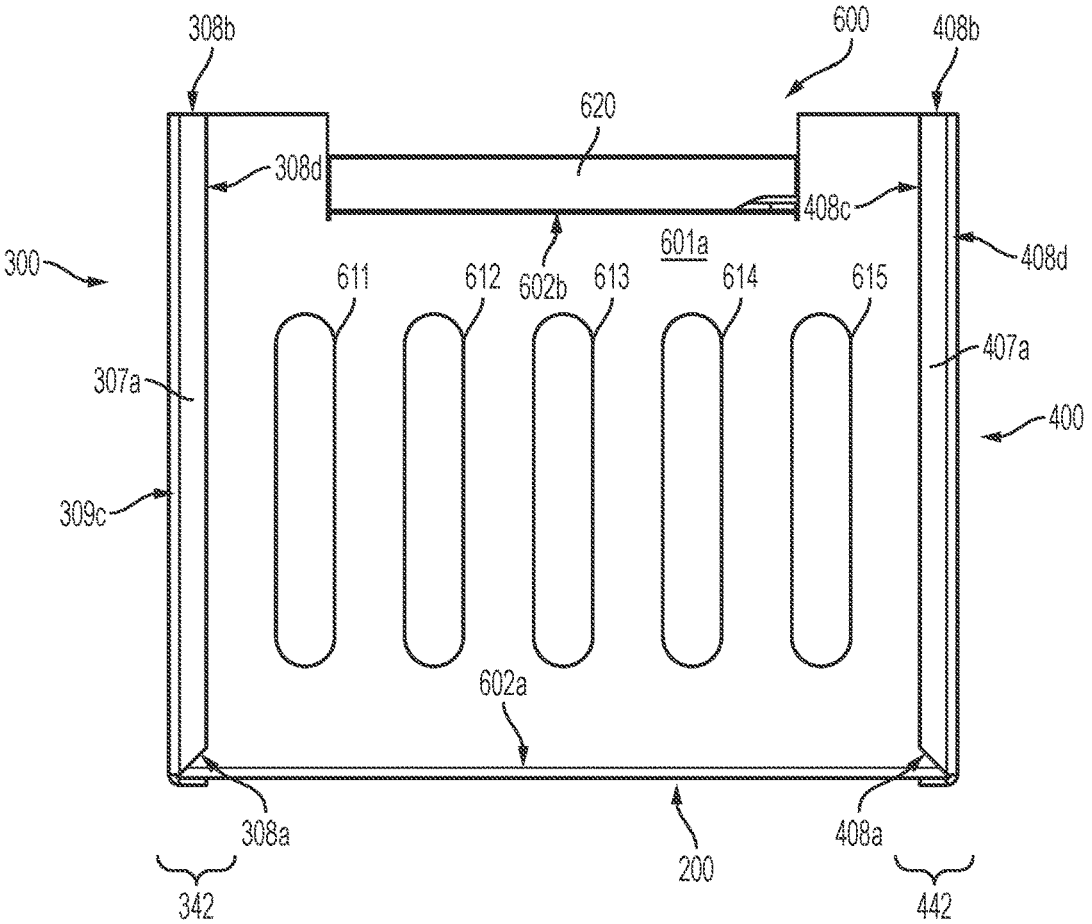
FIG. 12 is a three-dimensional diagram illustrating a front side view of the equipment locking system without a locking mechanism and anti-intrusion lid, in accordance with one or more implementations.

As illustrated in FIG. 12, a front side view of base container 100 without anti-intrusion lid 700 and locking mechanism 800.

Figure 13:
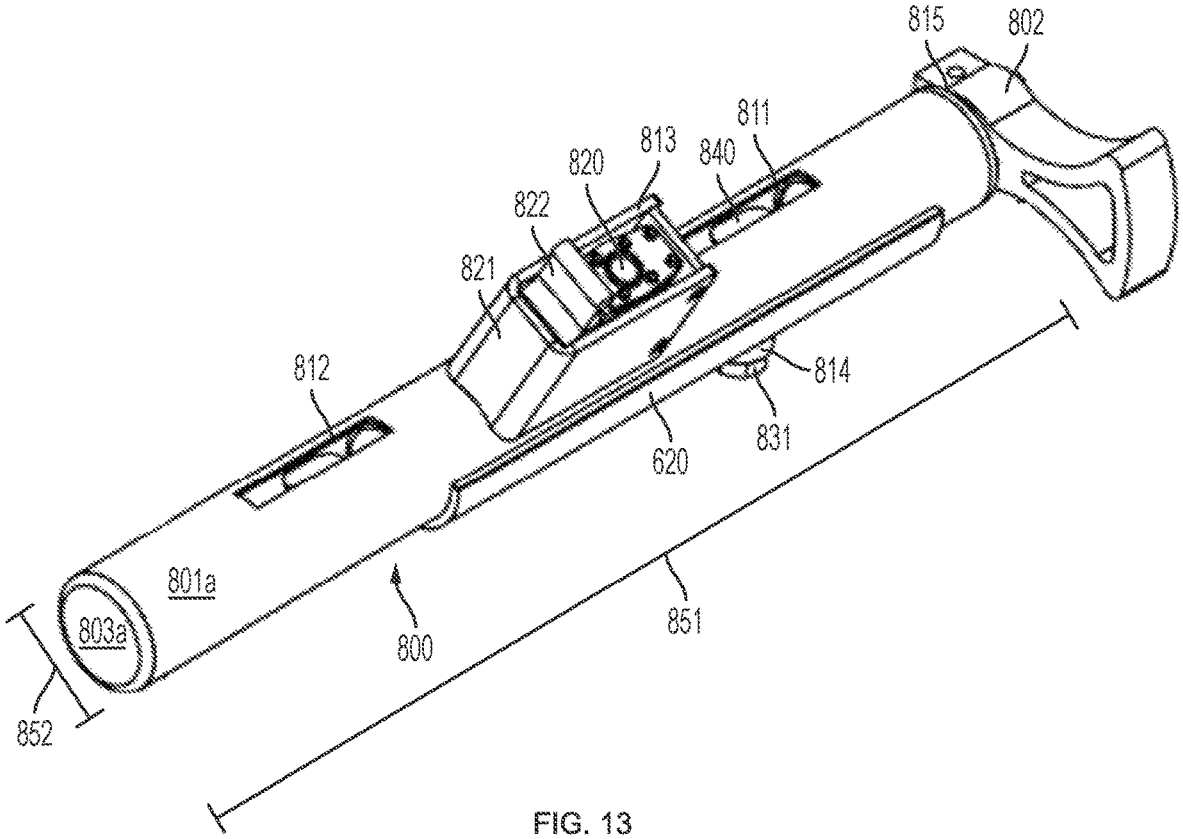
FIG. 13 is a three-dimensional diagram illustrating a locking mechanism in a locked position attached to a lock attachment of the equipment locking system, in accordance with one or more implementations.

As illustrated in FIG. 13, a view of locking mechanism 800 in the locked position and coupled to first lock attachment 620.

As illustrated in FIG. 14, the front side view of base container 100 with a cutaway view of locking mechanism 800 in the unlocked position.

Figure 15:
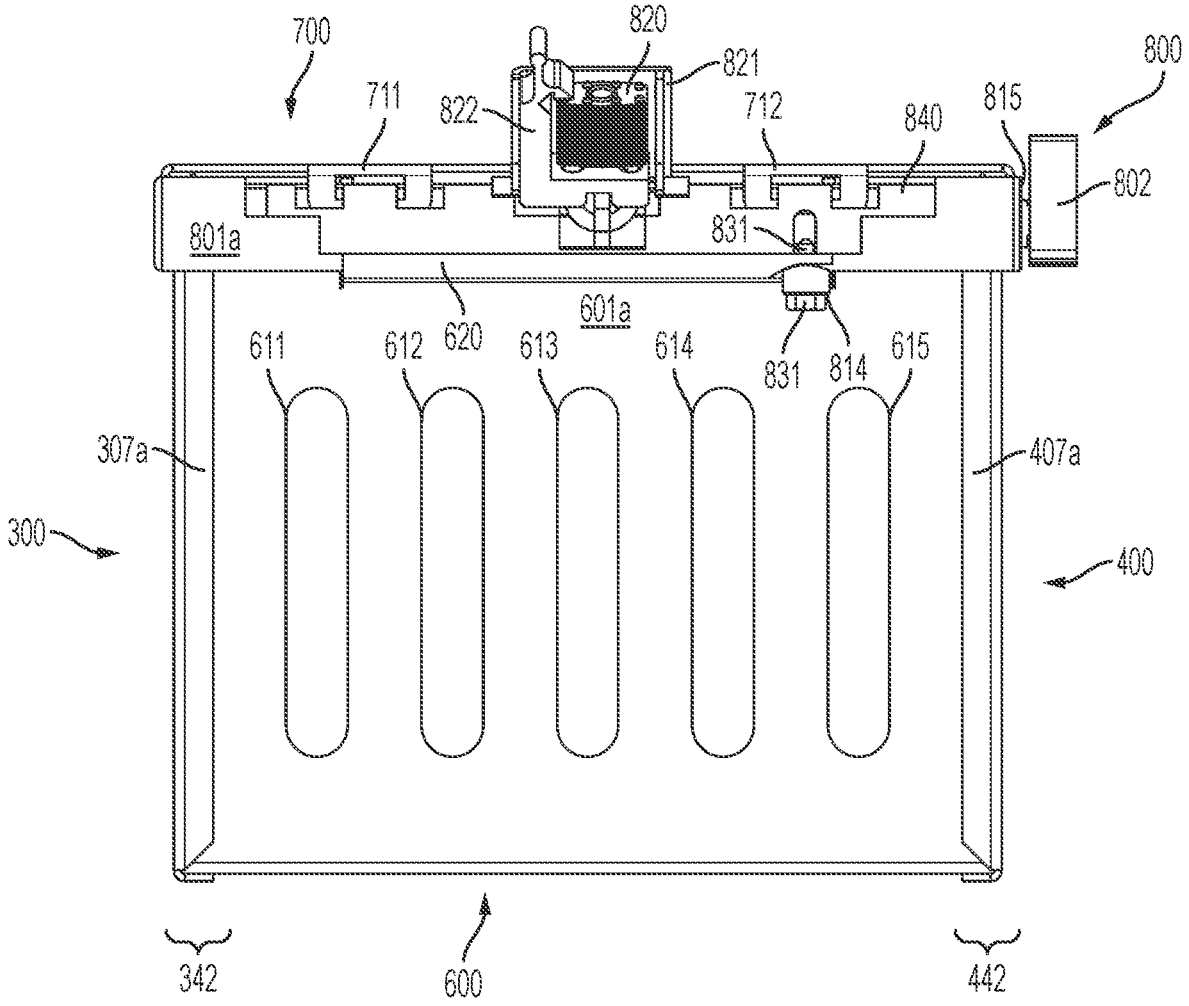
FIG. 15 is a three-dimensional diagram illustrating the cutaway view of the locking mechanism in a closed position on the equipment locking system, in accordance with one or more implementations.

As illustrated in FIG. 15, the front side view of base container 100 with a cutaway view of locking mechanism 800 in the locked position.

As illustrated in FIG. 16, a view of equipment 900 being positioned inside the partial enclosure of base container 100 while rotatable anti-intrusion lid 700 is opened and locking mechanism 800 is in the unlocked position.

As illustrated in FIG. 17, a view from the top of equipment 900 being positioned inside the partial enclosure of base container 100 while rotatable anti-intrusion lid 700 is opened and locking mechanism 800 is in the unlocked position.

As illustrated in FIG. 18, a view of equipment 900 being positioned inside the partial enclosure of base container 100 while rotatable anti-intrusion lid 700 is closed and locking mechanism 800 is in the locked position. Base container 100 may prevent access to equipment 900 while rotatable anti-intrusion lid 700 is closed and locking mechanism 800 is in the locked position. Base container 100 may prevent intrusion in the partial enclosure of base container 100 while rotatable anti-intrusion lid 700 is opened and locking mechanism 800 is in the locked position.

Although the system(s) and/or method(s) of this disclosure have been described in detail for the purpose of illustration based on what is currently considered to be the most practical and/or preferred implementations, it is to be understood that such detail is solely for that purpose and/or that the disclosure is not limited to the disclosed implementations, but, on the contrary, is intended to cover modifications and/or equivalent arrangements that are within the spirit and/or scope of the appended claims. For example, it is to be understood that the present disclosure contemplates that, to the extent possible, one or more features of any implementation can be combined with one or more features of any other implementation.

What is claimed:

1. An equipment locking system, comprising:

a base container forming a partial enclosure, the base container including a bottom wall and a set of sidewalls, the partial enclosure formed by the base container being configured to at least partially enclose a piece of equipment within the base container, the equipment having a handle and a functional end opposite the handle, the set of sidewalls traversing the bottom wall along a perimeter of the bottom wall, wherein the bottom wall and the set of sidewalls are joined together to form the partial enclosure, the set of sidewalls comprising:

a first sidewall traversing a first perimeter portion of the bottom wall, the first sidewall having a handle-accommodation gap configured to permit the handle of the equipment to extend from within the base container to an exterior of the base container via the handle accommodation gap;

a second sidewall traversing a second perimeter portion of the bottom wall, the second perimeter portion being opposite the first perimeter portion, the second sidewall having a functional-end-accommodation gap configured to permit the functional end of the equipment to extend from within the base container to the exterior of the base container via the functional-end-accommodation accommodation gap;

a third sidewall traversing a third perimeter portion of the bottom wall; and a fourth sidewall traversing a fourth perimeter portion of the bottom wall, fourth sidewall being opposite the third sidewall;

a locking mechanism coupled to the third sidewall, the locking mechanism including an outer shell housing, an internal locking mechanism, a handle, a rotation limiter bolt, a rotational restriction lock, a rotational restriction lock attachment, and a lock housing; and a rotatable anti-intrusion lid coupled to the fourth sidewall of the base container, the rotatable anti-intrusion lid including a complementary locking mechanism such that rotation of the rotatable anti-intrusion lid into a closed position causes the complementary locking mechanism of the rotatable anti-intrusion lid to engage with the locking mechanism coupled to the third sidewall, and wherein the closed position of the rotatable anti-intrusion lid restricts removal of the equipment from the base container.

2. The system of claim 1, wherein the handle-accommodation gap has a first gap width, and the functional-end-accommodation gap has a second gap width, wherein the first gap width is $\frac{3}{4}^{th}$ of the second gap width.

3. The system of claim 1, wherein the rotatable anti-intrusion lid is coupled to the fourth sidewall of the base container via one or more shielded hinges mounted within the partial enclosure formed by the base container.

4. The system of claim 1, wherein the first sidewall includes a first anti-intrusion lip and a second anti-intrusion lip, wherein the first anti-intrusion lip overlaps with a first edge of the third sidewall and the second anti-intrusion lip overlap with a first edge of the fourth sidewall, wherein such overlaps prevent intrusion into the partial enclosure.

5. The system of claim 1, wherein the second sidewall includes a third anti-intrusion lip and a fourth anti-intrusion lip, wherein the third anti-intrusion lip overlaps with a second edge of the third sidewall and the fourth anti-intrusion lip overlap with a second edge of the fourth sidewall, wherein such overlaps prevent intrusion into the partial enclosure.

6. The system of claim 1, wherein the rotatable anti-intrusion lid includes a fifth anti-intrusion lip and a sixth anti-intrusion lip, wherein the closed position of the rotatable anti-intrusion lid causes the fifth anti-intrusion lip to overlap with a third edge of the first sidewall and the sixth anti-intrusion lip to overlap with a third edge of the second sidewall, wherein such overlaps prevent intrusion into the partial enclosure when the lid is in the closed position.

7. The system of claim 1, wherein the bottom wall and the set of sidewalls are formed from a single sheet of material that is folded to form the base container.

8. The system of claim 1, wherein the third sidewall includes a mount for coupling the locking mechanism to the third sidewall.

9. The system of claim 1, wherein the outer shell housing includes a lid receptacle for receiving the complementary locking mechanism of the rotatable anti-intrusion lid, a rotation limiter bolt receptacle for receiving the rotation limiter bolt, and a lock receptacle for receiving the rotational restriction lock and the rotational restriction lock attachment.

10. The system of claim 9, wherein the rotation limiter bolt is configured to restrict the rotatable angle of the internal mechanism of the locking mechanism.

11. The system of claim 1, wherein the rotational restriction lock and the rotational restriction lock attachment restricts a movement of the internal locking mechanism of the locking mechanism when in the rotational restriction lock is in a locked position.

12. The system of claim 1, wherein a lock housing is configured to enclose the rotational restriction lock and the rotational restriction lock attachment, the enclosure of the lock housing prevents separation of the rotational restriction lock and the rotational restriction lock attachment when the rotational restriction lock is in the locked position.

13. An equipment locking system, comprising:

a base container forming a partial enclosure, the base container including a bottom wall and a set of sidewalls, the partial enclosure formed by the base container being configured to at least partially enclose a piece of equipment within the base container, the equipment having a handle and a functional end opposite the handle, the set of sidewalls traversing the bottom wall along a perimeter of the bottom wall, wherein the bottom wall and the set of sidewalls are joined together to form the partial enclosure, the set of sidewalls comprising:

a first sidewall traversing a first perimeter portion of the bottom wall, the first sidewall having a handle-accommodation gap and a first set of anti-intrusion lips, the handle-accommodation gap is configured to permit the handle of the equipment to extend from within the base container to an exterior of the base container via the handle accommodation gap, the first set of anti-intrusion lips is configuring to prevent intrusion into the partial enclosure, the first set of anti-intrusion lips including a first anti-intrusion lip overlapping with a first edge of the third sidewall and a second anti-intrusion lip overlapping with a first edge of the fourth sidewall;

a second sidewall traversing a second perimeter portion of the bottom wall, the second perimeter portion being opposite the first perimeter portion, the second sidewall having a functional-end-accommodation gap and a second set of anti-intrusion lips, the functional-end-accommodation gap is configured to permit the functional end of the equipment to extend from within the base container to the exterior of the base container via the functional-end-accommodation accommodation gap, the second set of anti-intrusion lips is configuring to prevent intrusion into the partial enclosure, the second set of anti-intrusion lips including a third anti-intrusion lip overlapping with a second edge of the third sidewall and a fourth anti-intrusion lip overlapping with a second edge of the fourth sidewall;

a third sidewall traversing a third perimeter portion of the bottom wall; and a fourth sidewall traversing a fourth perimeter portion of the bottom wall, fourth sidewall being opposite the third sidewall;

a locking mechanism coupled to the third sidewall; and a rotatable anti-intrusion lid coupled to the fourth sidewall of the base container, the rotatable anti-intrusion lid including a complementary locking mechanism and a third set of anti-intrusion lips, complementary locking mechanism is configured such that rotation of the rotatable anti-intrusion lid into a closed position causes the complementary locking mechanism of the rotatable anti-intrusion lid to engage with the locking mechanism coupled to the third sidewall, and wherein the closed position of the rotatable anti-intrusion lid restricts removal of the equipment from the base container, the third set of anti-intrusion lips is configuring to prevent intrusion into the partial enclosure, the third set of anti-intrusion lips including a fifth anti-intrusion lip overlapping with a third edge of the first sidewall and a sixth anti-intrusion lip to overlapping with a third edge of the second sidewall.

14. The system of claim 13, wherein the handle-accommodation gap has a first gap width, and the functional-end-accommodation gap has a second gap width, wherein the first gap width is $\frac{3}{4}^{th}$ of the second gap width.

15. The system of claim 13, wherein the rotatable anti-intrusion lid is coupled to the fourth sidewall of the base container via one or more shielded hinges mounted within the partial enclosure formed by the base container.

16. The system of claim 13, wherein the bottom wall and the set of sidewalls are formed from a single sheet of material that is folded to form the base container.

17. The system of claim 13, wherein the third sidewall includes a mount for coupling the locking mechanism to the third sidewall.

18. The system of claim 13, wherein the locking mechanism coupled to the third sidewall includes an outer shell housing, an internal locking mechanism, a handle, a rotation limiter bolt, a rotational restriction lock, a rotational restriction lock attachment, and a lock housing, the outer shell housing includes a lid receptacle for receiving the complementary locking mechanism of the rotatable anti-intrusion lid, a rotation limiter bolt receptacle for receiving the rotation limiter bolt, and a lock receptacle for receiving the rotational restriction lock and the rotational restriction lock attachment.

19. The system of claim 18, wherein the rotational restriction lock and the rotational restriction lock attachment restricts a movement of the internal locking mechanism of the locking mechanism when in the rotational restriction lock is in a locked position; and the rotation limiter bolt is configured to restrict the rotatable angle of the internal mechanism of the locking mechanism.

* * * * *